US008881653B2

(12) United States Patent
Yamauchi

(10) Patent No.: US 8,881,653 B2
(45) Date of Patent: Nov. 11, 2014

(54) PRINTING DEVICE AND METHOD FOR DETECTING PAPER WIDTH DIRECTION EDGE POSITION

(75) Inventor: Junichi Yamauchi, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 80 days.

(21) Appl. No.: 13/605,755

(22) Filed: Sep. 6, 2012

(65) Prior Publication Data

US 2013/0074720 A1 Mar. 28, 2013

(30) Foreign Application Priority Data

Sep. 28, 2011 (JP) ..... 2011-212932

(51) Int. Cl.
*B41F 21/14* (2006.01)
*B41J 11/00* (2006.01)
*B41J 29/38* (2006.01)

(52) U.S. Cl.
CPC ..... *B41J 29/38* (2013.01); *B41J 11/0095* (2013.01)
USPC ..... 101/485; 101/483

(58) Field of Classification Search
USPC ..... 101/485
See application file for complete search history.

(56) References Cited

U.S. PATENT DOCUMENTS 4,628,239 A * 12/1986 Everett, Jr. ..... 318/685
4,644,372 A * 2/1987 Hirota ..... 346/138
4,707,159 A * 11/1987 Hirano et al. ..... 400/639.1
5,007,751 A * 4/1991 Yamakawa ..... 400/322
5,080,509 A * 1/1992 Stone ..... 400/23
5,127,752 A * 7/1992 Courtney ..... 400/342
5,397,192 A * 3/1995 Khormaee ..... 400/708
5,620,266 A * 4/1997 Kim ..... 400/279
5,864,774 A * 1/1999 Jones ..... 702/94
5,868,075 A * 2/1999 Kline et al. ..... 101/467
2005/0058495 A1 3/2005 Sakai et al.

FOREIGN PATENT DOCUMENTS

CN 1590116 A 3/2005
JP 1987-070075 A 3/1987
JP 2007-145540 A 6/2007

OTHER PUBLICATIONS

First Office Action of Chinese Patent Application No. 201210367742.9 dated Jul. 30, 2014 with whole translation.

* cited by examiner

*Primary Examiner* — Anthony Nguyen
(74) *Attorney, Agent, or Firm* — Maschoff Brennan

(57) ABSTRACT

A printing device includes a head unit having a print head and a sensor that detects a presence or an absence of a sheet, a drive unit that causes the head unit to move to a width direction orthogonal to a feeding direction of the sheet, and a control unit controlling a position of the print head to the sheet based on a detection result of the sensor, wherein the control unit executes a first control that obtains the detection result of the sensor whenever the head unit moves only a first interval to a specific direction from a reference position and a second control that, when a change from the presence to the absence of the sheet is detected by the sensor during the first control, obtains the detection result of the sensor whenever the head unit moves only a second interval that is shorter than the first interval.

12 Claims, 12 Drawing Sheets

PRINTING DEVICE AND METHOD FOR DETECTING PAPER WIDTH DIRECTION EDGE POSITION

CROSS-REFERENCE TO RELATED APPLICATION

This application is based upon and claims the benefit of priority of the prior Japanese Patent Application No. 2011-212932, filed on Sep. 28, 2011, the entire contents of which are incorporated herein by reference.

FIELD

The embodiments discussed herein are related to a printing device and a method for detecting a sheet (or paper) width direction edge position.

BACKGROUND

A printing device such as a serial printer conducts printing on sheet (or paper) by providing a print head and causing the print head to move to a width direction orthogonal to a feeding direction of the sheet. The print head forms dots on the sheet to print with a head pin that protrudes toward the sheet. This type of printer detects the right and left edge positions (sheet width direction edge positions) of the sheet when the sheet is loaded to reduce printing actions beyond the range of the sheet so that damage is not caused by the head pin moving beyond the sheet width and hitting a mechanism other than the sheet.

A typical construction and conventional method for detecting the right and left edge positions of sheet (sheet width direction edge position) will be explained with reference to FIGS. 10A, 10B, and 11. FIGS. 10A and 10B illustrate the structure of a typical printer head unit. FIG. 10A is a front view and FIG. 10B is a side view. FIG. 11 schematically illustrates main components of a typical printing device to explain the typical structure and conventional method for detecting the right and left edge positions of sheet (sheet width edge detection).

The printer explained herein is structured to allow the loading of a sheet 2 from the front or back of the printing device, and includes a head unit 10 of the printing device includes a print head 11, a pair of sensors 12*a* and 12*b*, a card guide 13, and a carrier 14 as illustrated in FIGS. 10A and 10B. The print head 11, the sensors 12*a* and 12*b*, and the card guide 13 are mounted on the carrier 14. The head unit 10 is constructed so as to be able to move in the width direction (horizontal direction in FIG. 11) with respect to the sheet 2 when the carrier 14 is driven by a drive unit (not illustrated).

The sheet 2 which receives the printing is loaded from the front (lower part of FIG. 11) or from the rear in FIG. 11 (upper part of FIG. 11) of the printing device, and is guided between the print head 11 and a platen 20 by the card guide 13. The print head 11 (head unit 10) performs printing on the aforementioned guided sheet 2 while moving in the width direction (left and right directions in FIG. 11) of the sheet 2.

The sensors 12*a* and 12*b* are provided as a pair of right and left sensors, and each of the sensors 12*a* and 12*b* is a reflective type sensor that detects the presence or absence of the sheet 2. The sensors 12*a* and 12*b* are placed on either side of the print head 11 in the width direction (horizontal direction in FIG. 11) with a specific distance provided there-between, and are placed with a specific distance between each other in the feeding direction (vertical direction in FIG. 11) of the sheet 2.

The sensor 12*a* is placed closer to the front (downward direction in FIG. 11) of the printer than the sensor 12*b* in FIG. 11.

With the above configuration, the positions of the left and right edges 2*a* and 2*b* of the sheet 2 are conventionally detected with the procedure described below. The following explanation assumes that the sheet 2 is loaded from the front of the printing device. As illustrated in FIG. 11, the head unit 10 is placed in the center position (refer to the dashed line) when the sheet 2 is loaded, and the left and right edges 2*a* and 2*b* of the sheet 2 are detected in a state in which both of the sensors 12*a* and 12*b* sense the sheet 2, that is, in a state in which the sheet 2 is loaded as far as the positions of the sensors 12*a* and 12*b*.

First, the head unit 10 is moved from the center position indicated by the dashed line in FIG. 11 to a left home position (chain double-dashed line in FIG. 11) that represents a reference position/point of origin position during front loading. Since the sheet 2 is generally not present at the left home position, the sensor 12*a* detects a state of absence of the sheet 2 (the color of the platen 20 is black). Next, while the head unit 10 is moved from the left home position to the right (see arrow A1 in FIG. 11), the sensor 12*a* detects the position of the left edge 2*a* of the sheet 2 by discriminating between the black color of the platen 20 and the white color of the sheet 2. Specifically, the position in which a change from black to white (change from absence to presence of sheet 2) is detected by the sensor 12*a* is detected as the position of the left edge 2*a* of the sheet 2.

When the left edge 2*a* of the sheet 2 is detected, the head unit 10 is moved from the left home position to the center position indicated by the dashed line in FIG. 11. Since the sheet 2 is generally present at the center position, the sensor 12*a* detects a present state of the sheet 2 (the color of the sheet 2 is white). Next, while moving the head unit 10 from the center position to the right (see arrow A2 in FIG. 11), the position of the right edge 2*b* of the sheet 2 is detected by the sensor 12*b* by discriminating between the black color of the platen 20 and the white color of the sheet 2. Specifically, the position in which a change (change from presence to absence of sheet 2) from white to black is detected by the sensor 12*b* is detected as the right edge 2*b* of the sheet 2.

A stepping motor is normally used as the drive unit (not illustrated) that moves the head unit 10. Thus, when positioning the head unit 10 at a specific position such as the center position, the head unit 10 first returns to the left home position that is the point of origin of the stepping motor before being positioned at the specific position.

When the sheet 2 is loaded from the rear of the printer, the right home position is used as the reference/point of origin position, and the positions of the left and right edges 2*a* and 2*b* of the sheet 2 are detected in an order in which right and left is reversed in comparison to when front loading occurs.

In the abovementioned conventional procedure, the sensors 12*a* and 12*b* are expected to scan the entire region including a range from the left home position up to the position where the left edge 2*a* is detected, and a range from the center position up to the position where the right edge 2*b* is detected, when front loading occurs. Similarly, the sensors 12*a* and 12*b* are expected to scan the entire region including a range from the right home position up to the position where the right edge 2*b* is detected, and a range from the center position up to the position where the left edge 2*a* is detected, when rear loading occurs.

As a result, processing to give an instruction to the stepping motor that drives the head unit 10 to move for each step, and processing to move the head unit 10 only the distance corresponding to one step to detect the presence or absence of the sheet 2, are repeated. In this way, performing the moving and detecting for each step takes the same amount of time as printing letters in the entire region in which the moving and detecting are performed. Thus, in the conventional procedure, a large amount of time is taken to detect the positions of the right and left edges 2*a* and 2*b* of the sheet 2 while performing the moving and detecting for each step.

There is a demand for printing devices such as serial printers to perform printing on preprinted sheet. Preprinted sheet is, for example, sheet on which boxes and logos and the like are printed ahead of time.

FIG. 12 illustrates an example of a preprinted sheet 2. As illustrated in the example in FIG. 12, printing with a low reflectance ratio (dark colored preprint) is applied as two preprint portions 2*c* and 2*d* at the top of the sheet 2. With this type of sheet 2, the sensor 12*b* may not be able to discriminate between the black color of the platen 20 and the right side preprint portion 2*c* when the sensor 12*b* attempts to detect the position of the right edge 2*b* of the sheet 2 while the head unit 10 is being moved from the center position to the right as illustrated in FIG. 11.

In this case as illustrated in FIG. 14, the sensor 12*b* mistakenly senses the left edge of the preprint portion 2*c* as the position of the right edge 2*b* of the sheet 2 such that printing data may only be printed to the left edge of the preprint portion 2*c* even though printing data to be printed as far as the right edge 2*b* of the sheet 2 is present (see FIG. 13). To avoid this state, the detection of the positions of the left and right edges 2*a* and 2*b* of the sheet 2 by the sensors 12*a* and 12*b* is cancelled. However, if the position detection is cancelled, there is a possibility that the printed may exceed the sheet area and the head pin may become damaged.

FIG. 13 illustrates an example of a desirable printing result on the sheet 2 illustrated in FIG. 12. FIG. 14 illustrates an example of a printing result when an edge position (right edge position) in the width direction of the sheet is mistakenly sensed due to the preprint on the sheet illustrated in FIG. 12.

As described above, to detect the positions of the left and right edges of the sheet takes a large amount of time in the conventional procedure since movement and detection are conducted for each single step.

Moreover, when detecting the positions of the left and right edges on preprinted sheet, the preprint portion is mistakenly sensed as the edge position of the sheet in the conventional procedure so that the printing of data is not able to be carried out in the desired range.

Japanese Laid-open Patent Publication No. 2007-145540 and Japanese Laid-open Patent Publication No. 62-70075 are examples of the related art.

SUMMARY

According to an aspect of the embodiments, a printing device including: a head unit that includes a print head that prints on a sheet and a sensor that detects a presence or an absence of the sheet; a drive unit that causes the head unit to move to a width direction that is orthogonal to a feeding direction of the sheet; and a control unit that controls a position of the print head to the sheet by controlling the drive unit based on a detection result of the sensor, wherein the control unit executes, at least in a state which the sheet is loaded to a position of the sensor, a first control that obtains the detection result of the sensor whenever the head unit moves only a first interval while the head unit is caused to move by the drive unit to a specific direction from a reference position and a second control that, when a change from the presence of the sheet to the absence of the sheet of the sheet or from the absence of the sheet to the presence of the sheet is detected by the sensor during the first control, obtains the detection result of the sensor whenever the head unit moves only a second interval that is shorter than the first interval while the head unit is caused to move by the drive unit to a specific direction from a position that is apart, only by the first interval, from a detection position of the change during the first control, in a direction opposite to the specific direction, and the control unit recognizes the detection position of the change from the second control as an edge position in the width direction of the sheet when the change from the presence of the sheet to the absence of the sheet or from the absence to the presence of the sheet is detected by the sensor during the second control.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 10A is a front view and FIG. 10B is a side view;

DESCRIPTION OF EMBODIMENTS

In the following description, the embodiments will be described in detail with reference to the drawings.

(1) First Embodiment (1-1) Configuration of First Embodiment

Figure 1:
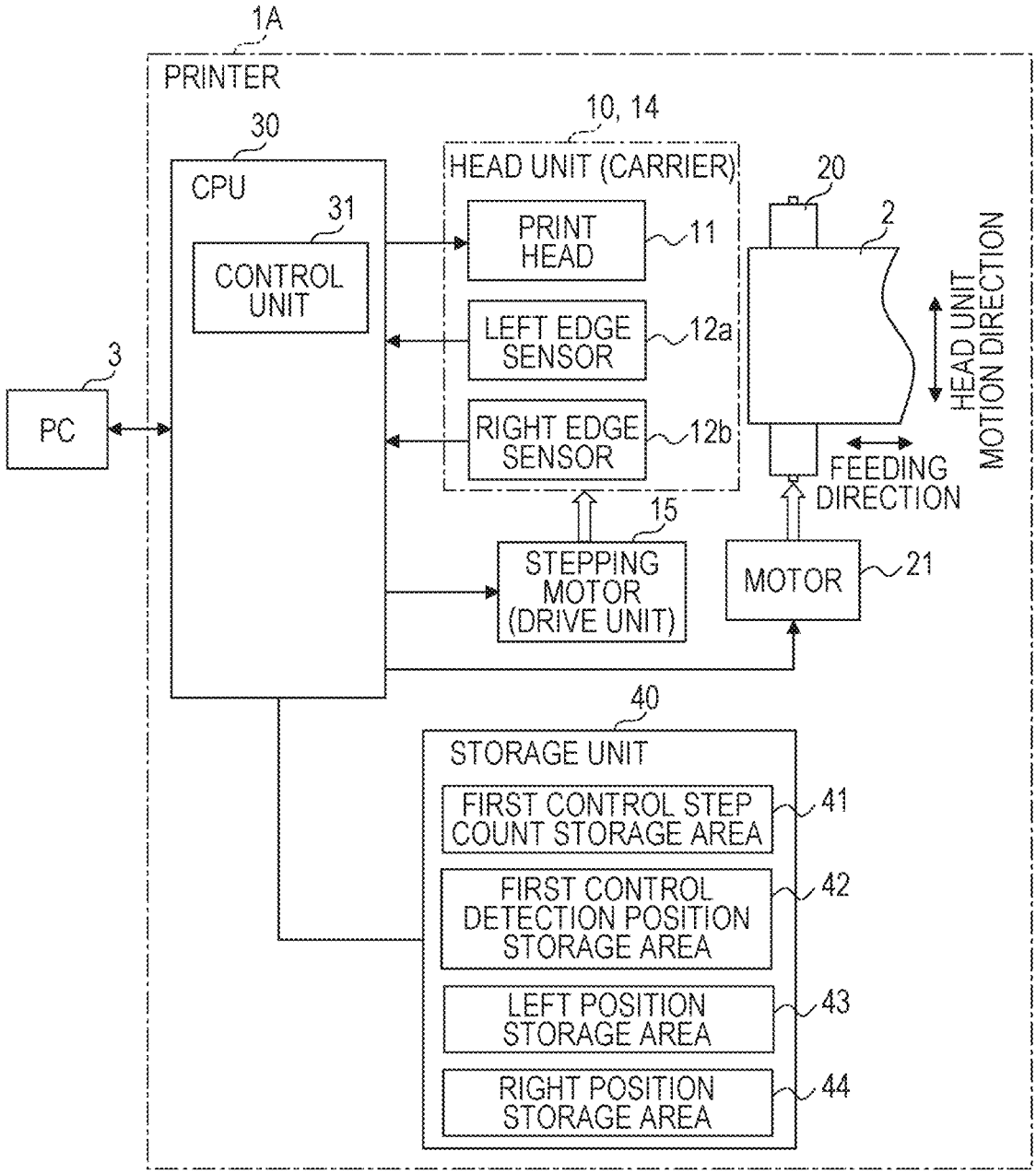
FIG. 1 is a block diagram describing a hardware configuration and a functional configuration of a printing device according to a first embodiment.

FIG. 1 is a block diagram indicating a hardware configuration and a functional configuration of a printing device (printer) 1A according to a first embodiment.

The printer 1A illustrated in FIG. 1 is, for example, a horizontal type serial printer that is configured to allow loading of a sheet 2 from the front or back of the printer. The printer 1A has a head unit 10, a stepping motor 15, a platen 20, a motor 21, a central processing unit (CPU) 30, and a memory unit 40.

Figure 10A:
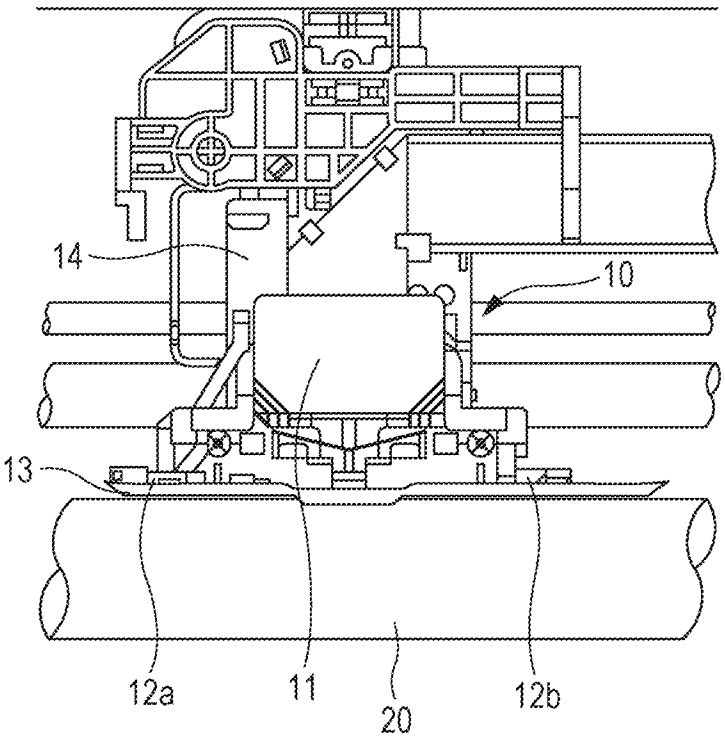
FIGS. 10A and 10B illustrate the structure of a head unit of a typical printing device, where
Figure 10B:
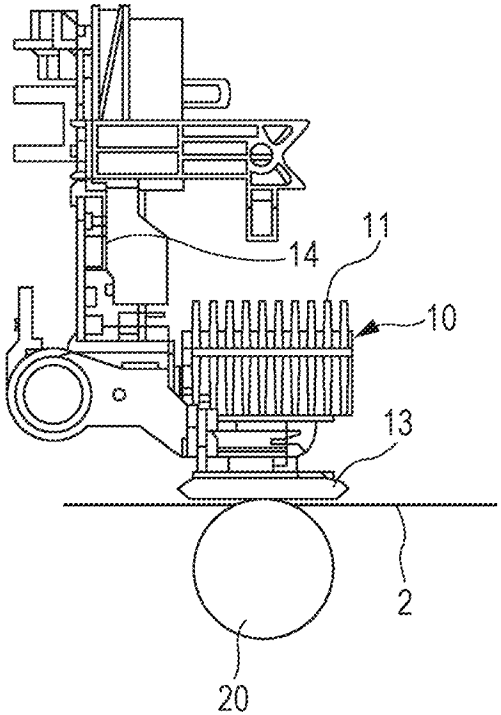

The head unit 10 has a print head 11, a left edge sensor 12*a*, a right edge sensor 12*b*, a card guide 13, and a carrier 14 as described above with reference to FIGS. 10A and 10B. The print head 11, the sensors 12*a* and 12*b*, and the card guide 13 are mounted onto the carrier 14. The head unit 10 is configured to be moveable in a width direction (horizontal direction in FIG. 11) that is orthogonal to a feeding direction (vertical direction in FIG. 11) of the sheet 2 due to the carrier 14 being driven by the stepping motor (drive unit) 15.

Figure 11:
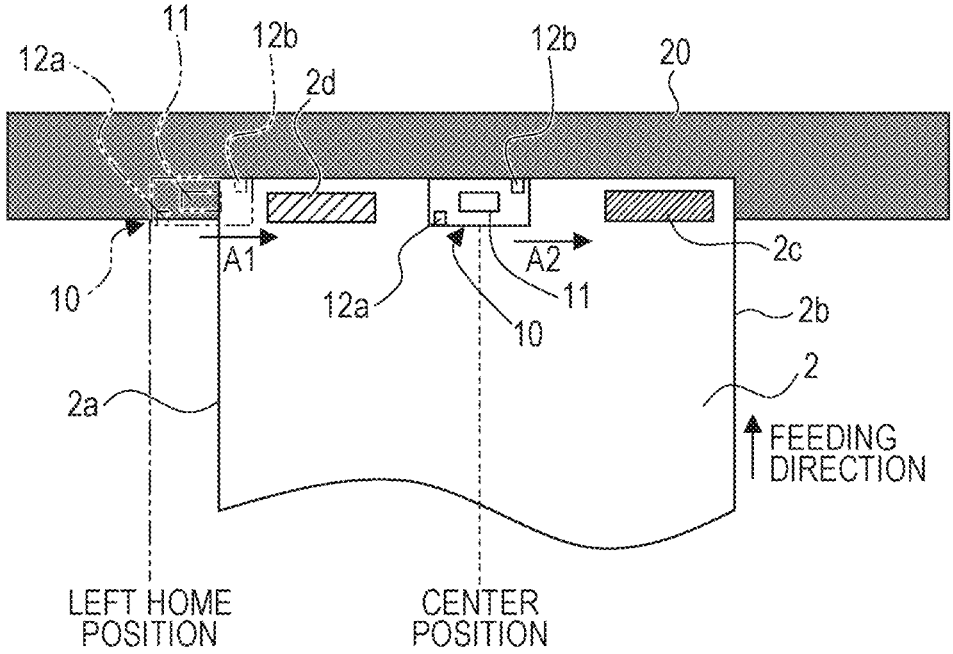
FIG. 11 schematically illustrates main components of a typical printing device to explain the typical structure and conventional method for detecting the right and left edge positions of a sheet.

The sheet 2 which receives the printing is loaded from the front (lower part of FIG. 11) or from the rear (upper part of FIG. 11) in FIG. 11 of the printer, and is guided between the print head 11 and the platen 20 by the card guide 13. The platen 20 performs loading and feeding of the sheet 2 by being rotated by the motor 21 such as a stepping motor and the like. The print head 11 (head unit 10) performs printing on the sheet 2, which is fed by the platen 20, while moving in the width direction (horizontal direction in FIG. 11) of the sheet 2.

The sensors 12*a* and 12*b* are reflective type sensors that detect the presence or absence of the sheet 2. Thus, when the sensors 12*a* and 12*b* detect a color with a low reflectance ratio (e.g., the black color of the platen 20), the sensors 12*a* and 12*b* are able to determine that there is no sheet 2. Conversely, when the sensors 12*a* and 12*b* detect a color with a high reflectance ratio (e.g., the white color of the sheet 2), the sensors 12*a* and 12*b* are able to determine that the sheet 2 is present.

The sensors 12*a* and 12*b* are placed on either side of the print head 11 in the width direction (horizontal direction in FIG. 11) with a specific distance provided there-between, and are placed in the feeding direction (vertical direction in FIG. 11) of the sheet 2 with a specific distance there-between. As described above, the sensor 12*a* is placed closer to the front (lower part of FIG. 11) of the printer than the sensor 12*b*. Thus, the sheet 2 is determined to have been loaded from the front of the printer when the sensor 12*a* senses the sheet 2 before the sensor 12*b* when the sheet 2 is being loaded. Conversely, the sheet 2 is determined to have been loaded from the back of the printer when the sensor 12*b* senses the sheet 2 before the sensor 12*a* when the sheet 2 is being loaded.

The CPU 30 is connected to a personal computer (PC) 3. The print head 11 and the motors 15 and 21 of the printer 1A are controlled for performing printing on the sheet 2 according to instructions from the PC 3 based on detection results from the sensors 12*a* and 12*b* and the like. In particular, the CPU 30 functions as the control unit 31 that controls the position of the print head 11 with respect to the sheet 2 by controlling the stepping motor 15 based on the detection results from the sensors 12*a* and 12*b*. The control unit 31 conducts actions (below-mentioned first control and second control) to detect the positions of the left and right edges 2*a* and 2*b* of the sheet 2 as described below. The CPU 30 executes a specific program to perform functions as the control unit 31 and the abovementioned control functions. The specific program is previously stored in the memory unit 40 and/or an external memory device (not illustrated) and the like connected to the CPU 30.

The memory unit 40 is configured by a random access memory (RAM) and the like, and has a first control step count storage area 41, a first control detection position storage area 42, a left edge position storage area 43, and a right edge position storage area 44.

The first control step count storage area 41 stores a first control step count set by the PC 3. The first control step count is set at "10" for example, and is prescribed as a movement amount of the head unit 10 during a first control (described below) by the control unit 31, or more specifically, a below-mentioned length of a first segment (detection width).

The first control detection position storage area 42 stores a position (e.g., positions P3 and P6 in FIG. 4) when a change from the presence to the absence of the sheet 2, or from the absence to the presence of the sheet 2, is detected by the sensors 12*a* and 12*b* accompanying the belowmentioned first control.

The left edge position storage area 43 stores the position (e.g., position P23 in FIG. 4) of the left edge 2*a* of the sheet 2 detected according to the present embodiment. The right edge position storage area 44 stores the position (e.g., position P53 in FIG. 4) of the right edge 2*b* of the sheet 2 detected according to the present embodiment.

In FIG. 1, the print head 11, the sensors 12*a* and 12*b*, the motors 15 and 21, and the memory unit 40 are illustrated as connected directly to the CPU 30; however, they may actually be connected to the CPU 30 via a bus or a suitable interface.

The control unit 31 executes a first control (FIGS. 2 and 3, steps A14 to A17, A23 to A27, A33 to A36, and A42 to A46) and a second control (FIGS. 2 and 3, steps A18 to A22, A28 to A32, A37 to A41, and A47 to A51) in a state in which the sheet 2 is at least loaded as far as the positions of the sensors 12*a* or 12*b*.

In the first control, the control unit 31 obtains detection results by the sensors 12*a* and 12*b* whenever the head unit 10 moves only a first interval while the control unit 31 causes the stepping motor (drive unit) 15 to move the head unit 10 from the reference position in a specific direction.

The first interval is an interval corresponding to a specific number of steps (not less than 2) of the stepping motor 15, and may be referred to hereinbelow as a "detection width." In the present embodiment, the first interval is prescribed according to a value set in the first control step count storage area 41 of the memory unit 40. For example, if "10" is set in the first control step count storage area 41 of the memory unit 40, the first interval becomes an interval corresponding to ten steps of the stepping motor 15.

When a change from the presence to the absence of the sheet 2, or from the absence to the presence of the sheet 2, is detected by the sensors 12*a* and 12*b* accompanying the first control, the control unit 31 switches to the second control after saving the changed detection position from the first control in the first control detection position storage area 42 of the memory unit 40.

In the second control, the control unit 31 causes the stepping motor 15 to move the head unit 10 in a specific direction from a position in the direction opposite the specific direction only by the first interval more than the change detection position from the first control. The control unit 31 then obtains detection results by the sensors 12*a* and 12*b* whenever the head unit 10 moves only a second interval. The second interval is an interval smaller than the first interval and corresponds to, for example, one step of the stepping motor 15.

When a change from the presence to the absence, or from the absence to the presence of the sheet 2 is detected by the sensor 12*a* and/or the sensor 12*b* accompanying the second control, the control unit 31 recognizes the change detection position from the second control as an edge position in the width direction of the sheet 2, namely the position of the left edge 2*a* or the right edge 2*b* of the sheet 2, and saves the edge position in the left edge position storage area 43 or the right edge position storage area 44.

The CPU 30 then recognizes the positions saved in the areas 43 or 44 of the memory unit 40 as the respective left edge 2*a* and the right edge 2*b* of the sheet 2 and performs printing control with respect to the sheet 2 such that printing is conducted within a range between the positions.

(1-2) Operation of First Embodiment

Figure 3:
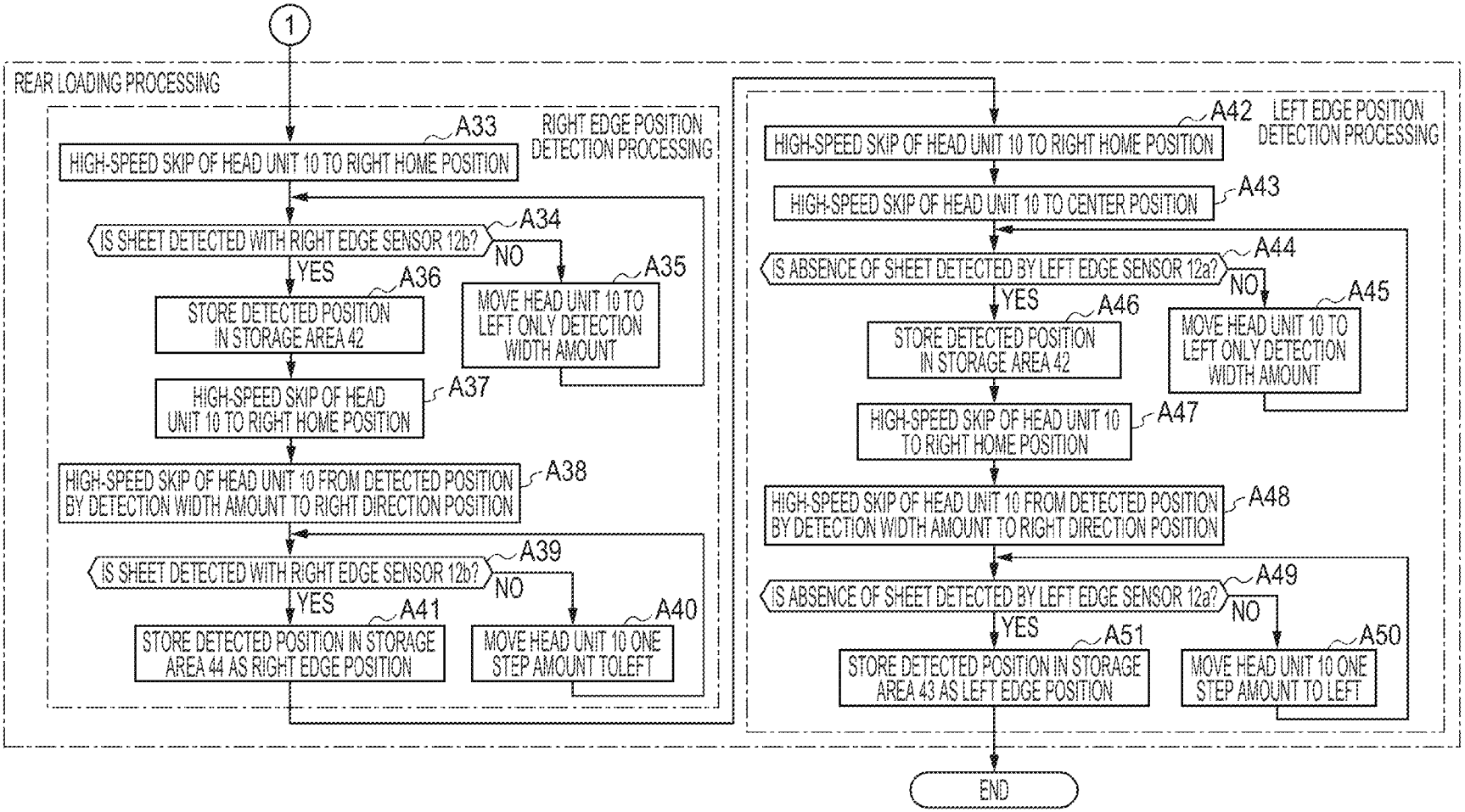
FIG. 3 is a method describing an action of the printing device illustrated in FIG. 1.
Figure 4:
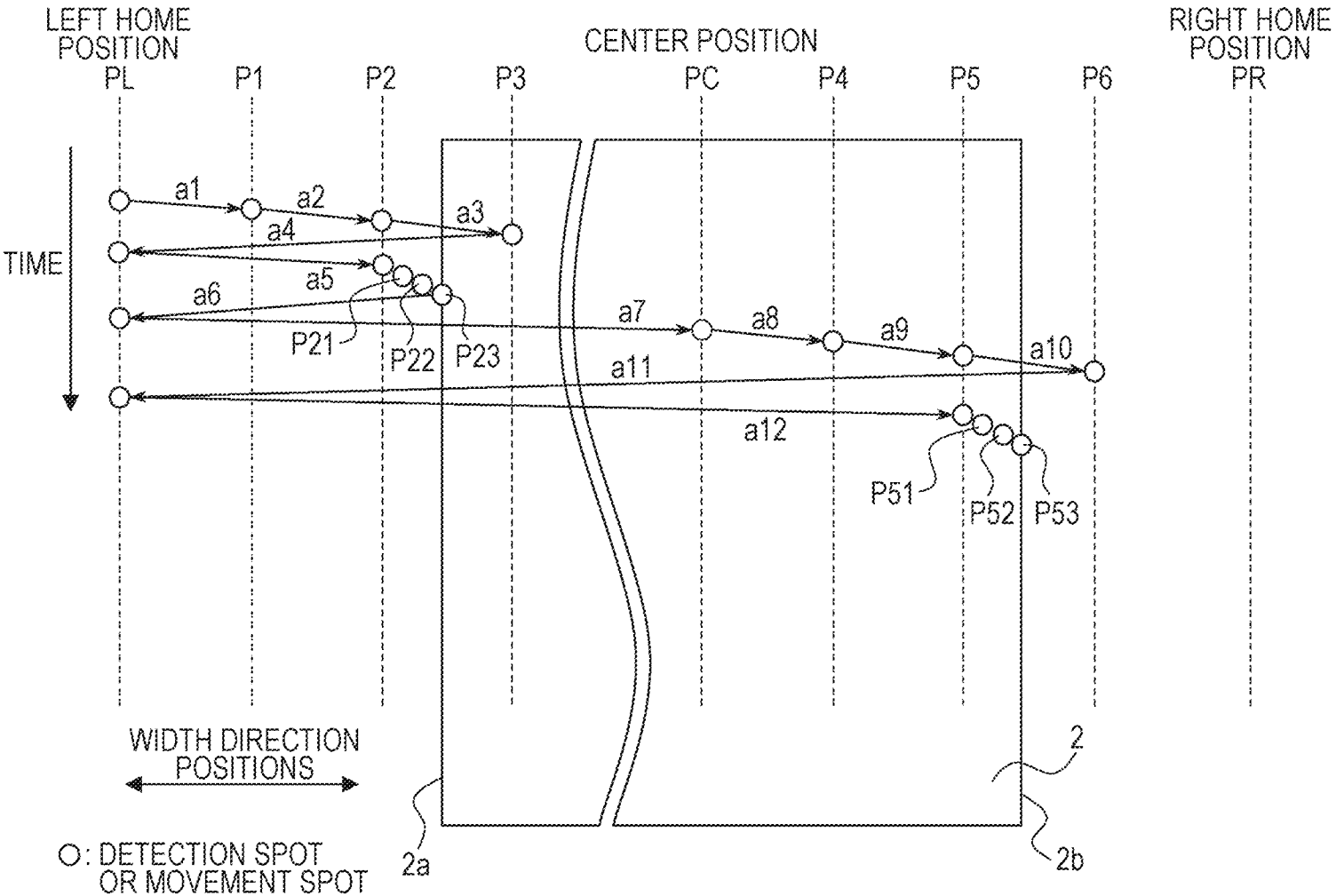
FIG. 4 specifically describes an action of the printing device illustrated in FIG. 1.

A procedure to detect the positions of the left and right edges 2*a* and 2*b* of the sheet 2 by the printer 1A that is configured as described above will be explained herein-below with reference to FIG. 4 according to the methods (steps A11 to A51) illustrated in FIGS. 2 and 3. FIG. 4 illustrates in detail the operations of the printer 1A when the sheet 2 is loaded from the front.

When the printer 1A is activated by an instruction from the PC 3, the number of first control steps (e.g., "10") that represents the detection width indicated by the PC 3 is first stored in the storage area 41 of the memory unit 40 (step A11). The control unit 31 then causes the head unit 10 to be moved to the center position (see position PC in FIG. 4) that is a center reference position, drives the platen 20 using the motor 21 to cause the sheet 2 to be loaded to the position in which the sheet 2 is sensed by the sensors 12*a* and 12*b*, that is, as far as the positions of the sensors 12*a* and 12*b* (step A12).

When the sheet 2 is loaded to the positions of the sensors 12*a* and 12*b*, the control unit 31 judges whether the loading direction of the sheet 2 is from the front of the printer (lower part of FIGS. 4 and 11) or from the rear of the printer (upper part of FIGS. 4 and 11) (step A13). The judgment is conducted on the basis of instruction information from the PC 3, or on the basis of the order of sensing of the sheet 2 by the sensors 12*a* and 12*b* as described above.

If the sheet 2 is loaded from the front of the printer 1A (step A13: YES route), the control unit 31 first causes the stepping motor 15 to skip the head unit 10 at high speed from the center position PC to the left home position (one edge reference position; see position PL in FIG. 4) where there is no sheet 2 (step A14).

The control unit 31 then causes the head unit 10 to be moved from the left home position PL in a specific direction (to the right) in units of detection widths until the sheet 2 is detected by the left edge sensor 12*a* (steps A15 and A16). Namely, if the sheet 2 is not detected by the left edge sensor 12*a* (step A15: NO route), the control unit 31 causes the head unit 10 to be moved by the stepping motor 15 to the right only by the detection width (ten steps) (step A16), and the processing returns to step A15. If the sheet 2 is detected by the left edge sensor 12*a* (step A15: YES route), the control unit 31 stores the detected position of the sheet 2 detected in step A15 (e.g., see position P3 in FIG. 4) in the storage area 42 of the memory unit 40 (step A17).

The control unit 31 then causes the stepping motor 15 to skip the head unit 10 at high speed from the detected position P3 to the left home position PL (step A18; see arrow a4 in FIG. 4).

The control unit 31 refers to the detected position in the storage area 42 of the memory unit 40 to derive a position (e.g., see position P2 in FIG. 4) that is only the detection width (ten steps) from the detected position on the left home position PL side (to the left). The control unit 31 then causes the stepping motor 15 to skip the head unit 10 at high speed from the left home position PL to the derived position P2 (step A19; see arrow a5 in FIG. 4).

The control unit 31 causes the head unit 10 to be moved in a specific direction (to the right) in step units of the stepping motor 15 from the position P2 to which the head unit 10 was moved to in step A19, until the sheet 2 is detected by the left edge sensor 12*a* (steps A20 and A21). Namely, if the sheet 2 is not detected by the left edge sensor 12*a* (step A20: NO route), the control unit 31 causes the head unit 10 to be moved by the stepping motor 15 to the right only by one step amount (step A21), and the processing returns to step A20. If the sheet 2 is detected by the left edge sensor 12*a* (step A20: YES route), the control unit 31 stores the detected position of the sheet 2 detected in step A20 (e.g., see position P23 in FIG. 4) in the left edge position storage area 43 of the memory unit 40 as the left edge (one edge position) 2*a* of the sheet 2 (step A22).

The control unit 31 then causes the stepping motor 15 to skip the head unit 10 at high speed from the position of the left edge 2*a* of the sheet 2 to the left home position PL (step A23; see arrow a6 in FIG. 4). The control unit 31 then causes the stepping motor 15 to skip the head unit 10 at high speed from the left home position PL to the center position PC of the sheet 2 (step A24; see arrow a7 in FIG. 4).

The control unit 31 causes the head unit 10 to be moved from the center position PC in a specific direction (to the right) in units of detection widths until the absence of the sheet 2 is detected by the right edge sensor 12*b* (steps A25 and A26). Namely, if the absence of the sheet 2 is not detected by the right edge sensor 12*b* (step A25: NO), the control unit 31 causes the head unit 10 to be moved by the stepping motor 15 to the right only by the detection width (ten steps) (step A26), and the processing returns to step A25. If the absence of the sheet 2 is detected by the right edge sensor 12*b* (step A25: YES), the control unit 31 stores the detected position of the absence of the sheet 2 detected in step A25 (e.g., see position P6 in FIG. 4) in the storage area 42 of the memory unit 40 (step A27).

The control unit 31 then causes the stepping motor 15 to skip the head unit 10 at high speed from the detected position P6 to the left home position PL (step A28; see arrow all in FIG. 4).

The control unit 31 refers to the detected position in the storage area 42 of the memory unit 40 to derive a position (e.g., see position P5 in FIG. 4) that is only the detection width (ten steps) away from the detected position on the left home position PL side (to the left). The control unit 31 then causes the stepping motor 15 to skip the head unit 10 at high speed from the left home position PL to the derived position P5 (step A29; see arrow a12 in FIG. 4).

The control unit 31 causes the head unit 10 to be moved in a specific direction (to the right) in step units of the stepping motor 15 from the position P5 to which the head unit 10 was moved to in step A29, until the absence of the sheet 2 is detected by the right edge sensor 12*b* (steps A30 and A31). Namely, if the absence of the sheet 2 is detected by the right edge sensor 12*b* (step A30: NO route), the control unit 31 causes the head unit 10 to be moved by the stepping motor 15 to the right only by one step amount (step A31), and the processing returns to step A30. If the absence of the sheet 2 is detected by the right edge sensor 12*b* (step A30: YES route), the control unit 31 stores the detected position where the absence of the sheet 2 was detected in step A30 (e.g., see position P53 in FIG. 4) in the right edge position storage area 44 of the memory unit 40 as the position of the right edge (other edge position) 2*b* of the sheet 2 (step A32), and the processing is completed.

The processing of the abovementioned steps A14 to A32 is processing conducted when the sheet 2 is loaded from the front of the printer 1A. The processing of the abovementioned steps A14 to A22 is processing to detect the position of the left edge 2*a* of the sheet 2. The processing of steps A14 to A17 is processing corresponding to the first control conducted by the control unit 31. The processing of the steps A18 to A22 is processing corresponding to the second control conducted by the control unit 31. Similarly, the abovementioned processing of the steps S23 to S32 is processing to detect the position of the right edge 2*b* of the sheet 2. The processing of steps A23 to A27 is processing corresponding to the first control conducted by the control unit 31. The processing of the steps A28 to A32 is processing corresponding to the second control conducted by the control unit 31.

Conversely, if the sheet 2 is loaded from the rear of the printer 1A (step A13: NO route), the control unit 31 first causes the stepping motor 15 to skip the head unit 10 at high speed from the center position to the right home position (other edge reference position; see position PR in FIG. 4) where there is no sheet 2 (step A33).

The control unit 31 then causes the head unit 10 to be moved from the right home position PR in a specific direction (to the left) in units of detection widths until the sheet 2 is detected by the right edge sensor 12*b* (steps A34 and A35). Namely, if the presence of the sheet 2 is not detected by the right edge sensor 12*b* (step A34: NO route), the control unit 31 causes the head unit 10 to be moved by the stepping motor 15 to the left only by the detection width (ten steps) (step A35), and the processing returns to step A34. If the sheet 2 is detected by the right edge sensor 12*b* (step A34: YES route), the control unit 31 stores the detected position of the sheet 2 detected in step A34 in the storage area 42 of the memory unit 40 (step A36).

The control unit 31 then causes the stepping motor 15 to skip the head unit 10 at high speed from the detected position to the right home position PR (step A37).

The control unit 31 refers to the detected position in the storage area 42 of the memory unit 40 to derive a position that is only the detection width (10 steps) away from the detected position on the right home position PR side (to the right). The control unit 31 then causes the stepping motor 15 to skip the head unit 10 at high speed from the right home position PR to the derived position (step A38).

The control unit 31 causes the head unit 10 to be moved in a specific direction (to the left) in step units of the stepping motor 15 from the position P2 to which the head unit 10 was moved to in step A38, until the presence of the sheet 2 is detected by the right edge sensor 12*b* (steps A39 and A40). Namely, if the presence of the sheet 2 is not detected by the right edge sensor 12*b* (step A39: NO route), the control unit 31 causes the head unit 10 to be moved by the stepping motor 15 to the right only by one step amount (step A40), and the processing returns to step A39. If the sheet 2 is detected by the right edge sensor 12*b* (step A39: YES route), the control unit 31 stores the detected position of the sheet 2 detected in step A39 in the right edge position storage area 44 of the memory unit 40 as the position of the right edge (other edge position) 2*b* of the sheet 2 (step A41).

The control unit 31 then causes the stepping motor 15 to skip the head unit 10 at high speed from the position of the right edge 2*b* of the sheet 2 to the right home position PR (step A42). The control unit 31 then causes the stepping motor 15 to skip the head unit 10 at high speed from the right home position PR to the center position PC of the sheet 2 (step A43).

The control unit 31 then causes the head unit 10 to be moved from the center position PC in a specific direction (to the left) in units of detection widths until the absence of the sheet 2 is detected by the left edge sensor 12*a* (steps A44 and A45). Namely, if the absence of the sheet 2 is not detected by the left edge sensor 12*a* (step A44: NO route), the control unit 31 causes the head unit 10 to be moved by the stepping motor 15 to the left only by the detection width (ten steps) (step A45), and the processing returns to step A44. If the absence of the sheet 2 is detected by the right edge sensor 12*b* (step A44: YES route), the control unit 31 stores the detected position of the absence of the sheet 2 detected in step A44 in the storage area 42 of the memory unit 40 (step A46).

The control unit 31 then causes the stepping motor 15 to skip the head unit 10 at high speed from the detected position detected in step A44 to the right home position PR (step A47).

The control unit 31 refers to the detected position in the storage area 42 of the memory unit 40 to derive a position that is only the detection width (ten steps) from the detected position on the right home position PR side (to the right). The control unit 31 then causes the stepping motor 15 to skip the head unit 10 at high speed from the right home position PR to the derived position (step A48).

The control unit 31 causes the head unit 10 to be moved in a specific direction (to the left) in step units of the stepping motor 15 from the position to which the head unit 10 was moved to in step A48, until the absence of the sheet 2 is detected by the left edge sensor 12*a* (steps A49 and A50). Namely, if the absence of the sheet 2 is not detected by the left edge sensor 12*a* (step A49: NO), the control unit 31 causes the head unit 10 to be moved by the stepping motor 15 to the left only by one step amount (step A50), and the processing returns to step A49. If the absence of the sheet 2 is detected by the left edge sensor 12*a* (step A49: YES), the control unit 31 stores the detected position where the absence of the sheet 2 is detected in step A49 as the position of the left edge (one edge position) 2*a* of the sheet 2 (step A51), and the processing is completed.

The processing of the abovementioned steps A33 to A52 is processing conducted when the sheet 2 is loaded from the rear of the printer 1A. The processing of the abovementioned steps A33 to A41 is processing to detect the position of the right edge 2*b* of the sheet 2. The processing of steps A33 to A36 is processing corresponding to the first control conducted by the control unit 31. The processing of the steps A37 to A41 is processing corresponding to the second control conducted by the control unit 31. Similarly, the processing of the abovementioned steps A42 to A51 is processing to detect the position of the left edge 2*a* of the sheet 2. The processing of steps A42 to A46 is processing corresponding to the first control conducted by the control unit 31. The processing of the steps A47 to A51 is processing corresponding to the second control conducted by the control unit 31.

(1-3) Specific Operation of First Embodiment

A specific operation of the printer 1A illustrated in FIG. 1 will be described next with reference to FIG. 4. As described above, FIG. 4 illustrates in detail the operations of the printer 1A when the sheet 2 is loaded from the front, and specifically illustrates the processing of steps A15 to A32 described above with reference to FIG. 2. The circles in FIG. 4 indicate detection spots where the presence or absence of the sheet 2 is detected by the sensor 12*a* or the sensor 12*b*, or movement spots that indicate to where the head unit 10 is moved.

In the example illustrated in FIG. 4, the head unit 10 is moved from the left home position PL as indicated by the arrows a1, a2, and a3, and the presence or absence of the sheet 2 is sensed by the left edge sensor 12*a* in units of ten steps at detection spots PL, P1, P2, and P3. Here, the sheet 2 is not detected at detection spots Pl, P1, or P2, but the sheet 2 is detected at the detection spot P3 when the head unit 10 is moved only thirty steps to the right from the left home position PL (step A15: YES route). The control unit 31 stores the position P3 in the storage area 42 of the memory unit 40 (step A17).

The control unit 31 then causes the head unit 10 to be skipped at high speed from the detected position P3 to the left home position PL as illustrated with arrow a4 (step A18). The head unit 10 is then skipped at high speed, as illustrated with arrow a5, from the left home position PL to the detection spot P2 that is one spot in front of the detection position P3 (step A19).

The head unit 10 is then moved from the detection spot P2 to the right one step at a time, and the presence or absence of the sheet 2 is sensed by the left edge sensor 12*a* at the detection positions P2, P21, P22, and P23. The sheet 2 is not detected at the detection positions P2, P21, or P22 at this time. However, the sheet 2 is detected at the detection spot P23 which is only three steps to the right from the detection spot P2 (step A20: YES route). The control unit 31 then recognizes the position of the detection spot P23 in which the absence of the sheet 2 changes to the presence of the sheet 2, as the position of the left edge 2*a* of the sheet 2, and stores the detection spot P23 in the left edge position storage area 43 of the memory unit 40 (step A22).

Therefore, the position of the left edge 2*a* that is sensed by moving the head unit 10 in step units from the left home position PL to the right twenty-three times in the conventional method, may be sensed by moving the head unit 10 eight times according to the present embodiment. Specifically, after moving the head unit 10 five times as indicated by the arrows a1 to a5, the left edge 2*a* may be sensed by moving the head unit 10 to the right three times in step units.

The head unit 10 is skipped at high speed from the position P23 of the left edge 2*a* to the left home position PL as illustrated with arrow a6 (step A23). The head unit 10 is skipped at high speed from the left home position PL to the center position PC as illustrated with arrow a7 (step A24).

The head unit 10 is then moved from the center position PC, as illustrated by the arrows a8, a9, and a10, and the presence or absence of the sheet 2 is sensed by the right edge sensor 12*b* at the detection spots PC, P4, P5, and P6 that are ten steps away from each other. Here, the sheet 2 is not detected at the detection spots PC, P4, or P5, but the absence of the sheet 2 is detected at the detection spot P6 when the head unit 10 is moved only thirty steps to the right from the center position PC (step A25: YES route). The control unit 31 stores the position P6 in the storage area 42 of the memory unit 40 (step A27).

The control unit 31 then causes the head unit 10 to be skipped at high speed from the detected position P6 to the left home position PL as illustrated with arrow a11 (step A28). The head unit 10 is then skipped at high speed, as illustrated with arrow a12, from the left home position PL to the detection spot P5 that is one spot in front of the detection position P6 (step A29).

The head unit 10 then is moved from the detection spot P5 to the right one step at a time, and the presence or absence of the sheet 2 is sensed by the right edge sensor 12*b* at the detection spots P5, P51, P52, and P53. The absence of the sheet 2 is not detected at the detection spots P5, P51, or P52, but the absence of the sheet 2 is detected at the detection spot P53 which is three steps to the right from the detection spot P5 (step A30: YES). The control unit 31 then recognizes the position of the detection spot P53 in which the presence of the sheet 2 changed to the absence of the sheet 2, as the position of the right edge 2*b* of the sheet 2, and stores the detection spot P53 in the right edge position storage area 44 of the memory unit 40 (step A32).

Therefore, the position of the right edge 2*b* that is sensed by moving the head unit 10 in step units from the center position PC to the right twenty-three times in the conventional method, may be sensed by moving the head unit 10 eight times according to the present embodiment. Specifically, after moving the head unit 10 five times as indicated by the arrows a8 to a12, the right edge 2*b* may be sensed by moving the head unit 10 to the right three times in step units.

Figure 2:
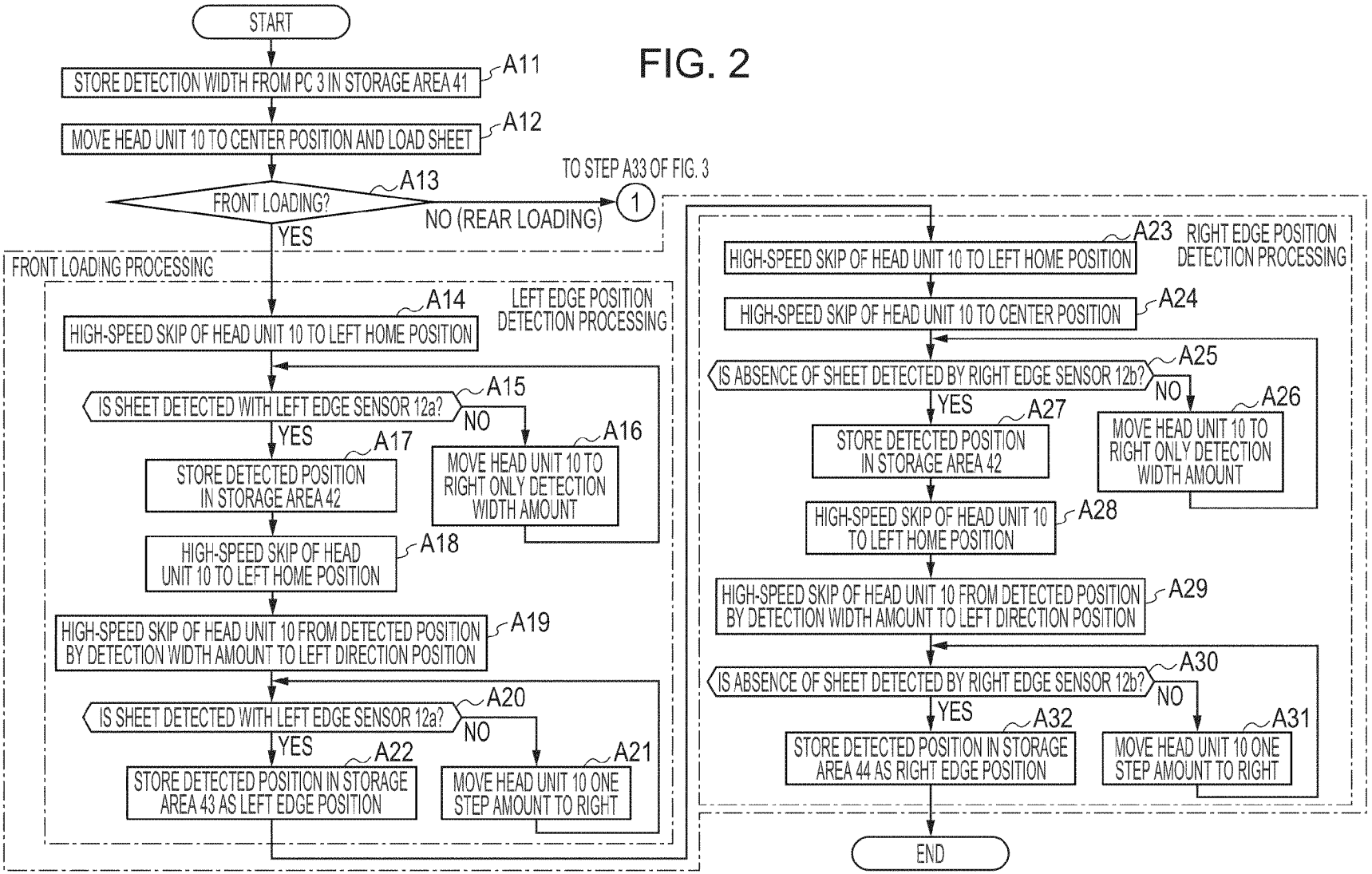
FIG. 2 is a method describing an action of the printing device illustrated in FIG. 1.

A detailed operation (in particular, the example of processing from steps A15 to A32 in FIG. 2) when the sheet 2 is loaded from the front of the printer 1A has been described in FIG. 4. However, the detailed operation (in particular, the example of processing from steps A34 to A51 in FIG. 2) when the sheet 2 is loaded from the rear of the printer 1A is conducted in a similar way as the operation example illustrated in FIG. 4. However, when the sheet 2 is loaded from the rear of the printer 1A, the right home position PR is used as the reference/point of origin position of the stepping motor 15, and the positions of the left and right edges 2*a* and 2*b* of the sheet 2 are detected in an order in which right and left is reversed in comparison to when front loading occurs.

(1-4) Effect of First Embodiment

In the conventional procedure, processing to give an instruction to the stepping motor to move one step at a time, and processing to move the head unit 10 only the interval corresponding to one step to detect the presence or absence of the sheet 2, are repeated. As a result, in the conventional procedure, the amount of time taken to detect the positions of the right and left edges 2*a* and 2*b* of the sheet 2 is similar to the amount of time taken to print letters across the entire range in which the moving and detecting are conducted.

Conversely, in the printer 1A of the first embodiment, first an instruction is given to the stepping motor 15 to move in units of ten steps, and the head unit 10 is moved in units of detection widths (first interval) that correspond to the ten steps such that the approximate positions of the left and right edges 2*a* and 2*b* are detected. The head unit 10 then is returned once to the home position PL or PR and then quickly moved to a position only a detection width in front of the aforementioned approximate position. The stepping motor 15 is then instructed to move one step at a time such that the presence or absence of the sheet 2 may be accurately sensed in each one step.

Therefore, when the approximate positions of the left and right edges 2*a* and 2*b* are detected in units of ten steps, the time taken to detect the approximate positions is one tenth of the time taken in the conventional method. As a result, when the presence or absence of the sheet 2 is sensed in one step units in the range of the detection width in which a change in presence or absence of the sheet 2 was detected, the time taken to accurately detect the position of the left and right edges 2*a* and 2*b* is greatly reduced in comparison to the conventional procedure.

For example as described above with reference to FIG. 4, in comparison to causing the head unit 10 to move twenty-three times to detect the positions of the left edge 2*a* or the right edge 2*b* in the conventional procedure, the printer 1A of the first embodiment is able to detect the left edge 2*a* or the right edge 2*b* by only causing the head unit 10 to be moved eight times. Therefore, the time taken to detect the positions of the left and right edges 2*a* and 2*b* is greatly reduced in comparison to the conventional procedure.

In this way, the detecting conducted at each step of the stepping motor 15 is reduced in the printer 1A of the first embodiment such that the approximate positions of the left and right edges 2*a* and 2*b* of the sheet 2 are detected in the first interval (e.g., an interval of ten step amounts) (first control).

Then, the presence or absence of the sheet 2 is accurately sensed in the second interval (e.g., an interval of one step amount) which is smaller than the first interval in the detection width range in which the presence or absence of the sheet 2 changes (second control). As a result, the positions of the left and right edges 2*a* and 2*b* of the sheet 2 that will receive the printing may be detected quickly and in a short time. According to the printer 1A of the first embodiment, the positions of the left and right edges 2*a* and 2*b* of the sheet 2 may be detected quickly and in a short time even if the sheet 2 is a non-standard form not related to sheet sizes.

(2) Second Embodiment (2-1) Configuration of Second Embodiment

Figure 5:
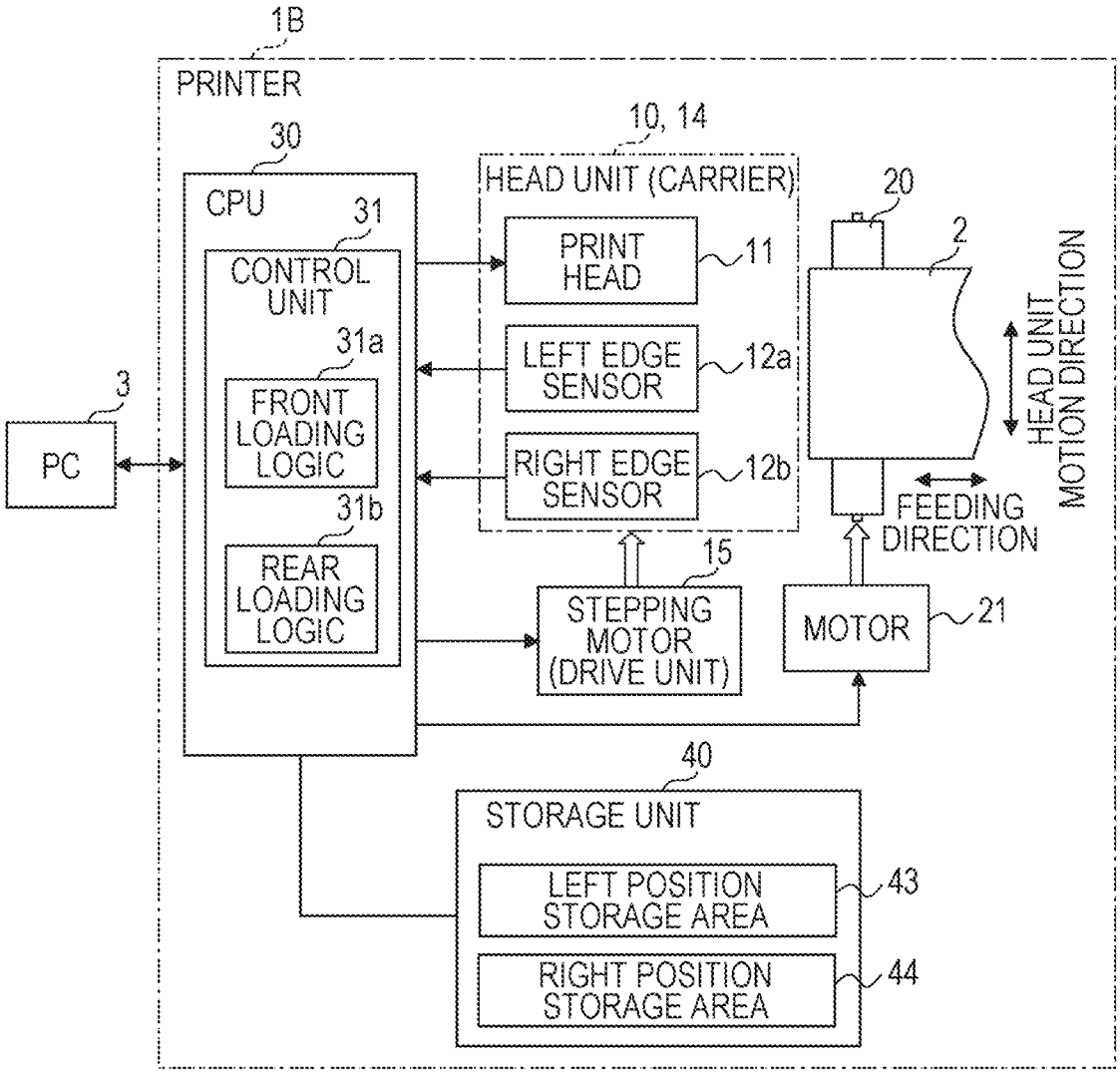
FIG. 5 is a block diagram describing a hardware configuration and a functional configuration of a printing device according to a second embodiment.

FIG. 5 is a block diagram indicating a hardware configuration and a functional configuration of a printing device (printer) 1B according to a second embodiment.

The printer 1B illustrated in FIG. 5 is, for example, a horizontal type serial printer that is configured to allow loading of the sheet 2 from the front or back of the printer in the same way as the printer 1A illustrated in FIG. 1. The printer 1B has a head unit 10, a stepping motor 15, a platen 20, a motor 21, a central processing unit (CPU) 30, and a memory unit 40. Reference numerals in FIG. 5 that are identical to the abovementioned reference numerals refer to substantially the same portions and thus detailed explanations thereof will be omitted.

The memory unit 40 in the printer 1B according to the second embodiment has at least a left edge position storage area 43 and a right edge position storage area 44 that are similar to those of the first embodiment.

The control unit 31 in the printer 1B of the second embodiment controls the position of the print head 11 with respect to the sheet 2 by controlling the stepping motor 15 based on the detection results from the sensors 12*a* and 12*b*, in the same way as the first embodiment. The control unit 31 of the second embodiment conducts actions to detect the positions of the left and right edges 2*a* and 2*b* of the sheet 2 as described below. The CPU 30 is realized by executing a specific program to perform functions as the control unit 31 to conduct the below-mentioned detection actions.

The control unit 31 conducts right edge position detection processing (FIG. 6 steps B13 to B16 and B25 to B28) and left edge position detection processing (FIG. 6 steps B17 to B20 and B21 to B24) in a state in which the sheet 2 is at least loaded to the positions of the sensors 12*a* and 12*b*.

In the left edge position detection processing, the control unit 31 causes the stepping motor 15 to move the head unit 10 in a specific direction (to the right) from a reference position (left home position) at one edge where there is no sheet 2. The control unit 31 then obtains detection results by the left edge sensor 12*a* whenever the head unit 10 moves only an interval that corresponds to one step amount of the stepping motor 15. When a change from the absence to the presence of the sheet 2 is detected by the left edge sensor 12*a*, the control unit 31 recognizes the change detection position as one edge portion position in the width direction of the sheet 2, namely the position of the left edge 2*a* of the sheet 2, and stores the changed detection position in the left edge position storage area 43.

In the right edge position detection processing, the control unit 31 causes the stepping motor 15 to move the head unit 10 in a specific direction (to the left) from a reference position (right home position) at the other edge where there is no sheet 2. The control unit 31 then obtains detection results by the right edge sensor 12*b* whenever the head unit 10 moves only an interval that corresponds to one step amount of the stepping motor 15. When a change from the absence to the presence of the sheet 2 is detected by the right edge sensor 12*b*, the control unit 31 recognizes the change detection position as the other edge portion position in the width direction of the sheet 2, namely the position of the right edge 2*b* of the sheet 2, and stores the change detection position in the right edge position storage area 44.

The CPU 30 then recognizes the positions saved in the areas 43 and 44 of the memory unit 40 as the respective left edge 2*a* and the right edge 2*b* of the sheet 2 and performs printing control with respect to the sheet 2 such that printing is conducted within the range between the positions.

In the second embodiment, the control unit 31 is constructed to be able to selectively switch between a front loading logic 31*a* and a rear loading logic 31*b* and execute the same. The control unit 31 then uses the front loading logic 31*a* to recognize the position of the left edge 2*a* of the sheet 2 by conducting the abovementioned left edge position detection processing, and also uses the rear loading logic 31*b* to recognize the position of the right edge 2*b* of the sheet 2 by conducting the abovementioned right edge position detection processing.

The front loading logic 31*a* and the rear loading logic 31*b* are used in a typical horizontal type serial printer.

The front loading logic 31*a* is executed by the CPU 30 executing a specific program since the front loading logic 31 a is used when the sheet 2 is loaded from the front of the printer. The front loading logic 31*a* recognizes the position where the change from the absence to the presence of the sheet 2 is detected by the left edge sensor 12*a* while the head unit 10 is moved from the left home position to the right by the stepping motor 15, as the position of the left edge 2*a* of the sheet 2. The front loading logic 31*a* recognizes the position where the change from the presence to the absence of the sheet 2 is detected by the right edge sensor 12*b* while the head unit 10 is moved from the center position to the right by the stepping motor 15, as the position of the right edge 2*b* of the sheet 2. In the second embodiment, only the processing to detect and recognize the left edge 2*a* by the front loading logic 31*a* is used during the left edge position detection processing.

The rear loading logic 31*b* is executed by the CPU 30 executing a specific program since the rear loading logic 31*b* is used when the sheet 2 is loaded from the rear of the printer. The rear loading logic 31*b* recognizes the position where the change from the absence to the presence of the sheet 2 is detected by the right edge sensor 12*b* while the head unit 10 is moved from the right home position to the left by the stepping motor 15, as the position of the right edge 2*b* of the sheet 2. The rear loading logic 31*b* recognizes the position where the change from the presence to the absence of the sheet 2 is detected by the left edge sensor 12*a* while the head unit 10 is moved from the center position to the left by the stepping motor 15, as the position of the left edge 2*a* of the sheet 2. In the second embodiment, only the processing to detect and recognize the right edge 2*b* by the rear loading logic 31*b* is used during the right edge position detection processing.

(2-2) Operations of Second Embodiment

Figure 6:
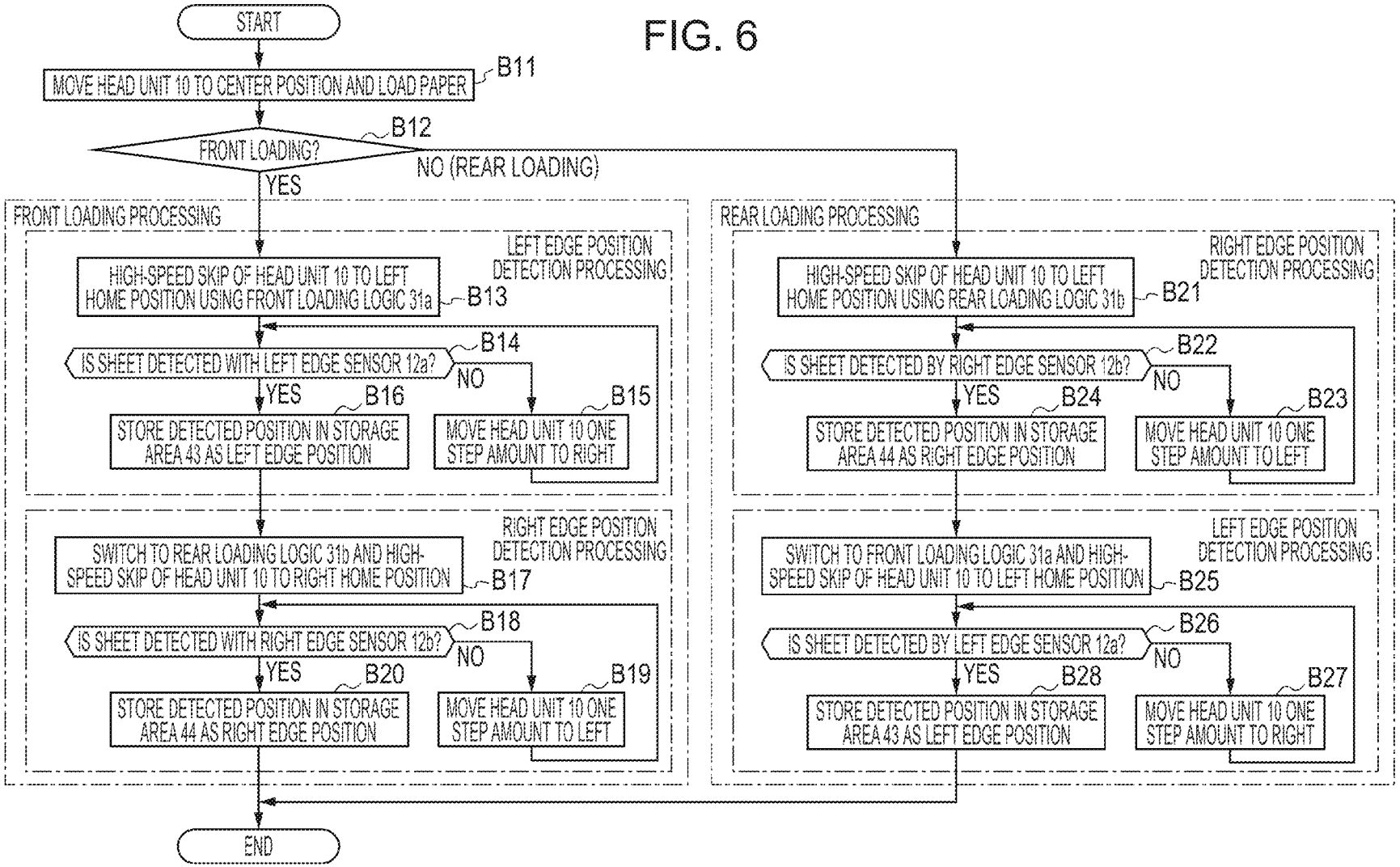
FIG. 6 is a method describing an action of the printing device illustrated in FIG. 5.

An explanation of a procedure to detect the left and right edges 2*a* and 2*b* of the sheet 2 in the printer 1B configured as described above will be explained with reference to the method (steps B11 to B28) illustrated in FIG. 6.

After the printer 1B is activated by an instruction from the PC 3, the control unit 31 first causes the head unit 10 to be moved to the center position PC (see FIG. 4), and drives the platen 20 using the motor 21 to cause the sheet 2 to be loaded to the position in which the sheet 2 is sensed by both of the sensors 12*a* and 12*b*, that is, as far as the positions of the sensors 12*a* and 12*b* (step B11).

When the sheet 2 is loaded to the positions of the sensors 12*a* and 12*b*, the control unit 31 judges whether the loading direction of the sheet 2 is from the front of the printer or from the rear of the printer (step B12). The judgment is conducted on the basis of instruction information from the PC 3, or on the basis of the order of sensing of the sheet 2 by the sensors 12*a* and 12*b* as described above.

When the sheet 2 is loaded from the front of the printer (step B12: Yes route), the control unit 31 begins the left edge position detection processing that uses the front loading logic 31*a*. The control unit 31 first causes the stepping motor 15 to skip the head unit 10 at high speed from the center position PC to the left home position PL (see FIG. 4) where there is no sheet 2 (step B13).

The control unit 31 then causes the head unit 10 to be moved from the left home position PL to the right in step units of the stepping motor 15 until the sheet 2 is detected by the left edge sensor 12*a* (steps B14 and B15). Namely, if the sheet 2 is not detected by the left edge sensor 12*a* (step B14: NO route), the control unit 31 causes the head unit 10 to be moved by the stepping motor 15 to the right only by one step amount (step B15), and the processing returns to step B14. If the sheet 2 is detected by the left edge sensor 12*a* (step B14: YES route), the control unit 31 stores the detected position of the sheet 2 detected in step B14 in the left edge position storage area 43 of the memory unit 40 as the position of the left edge 2*a* of the sheet 2 (step B16).

The control unit 31 then switches from the front loading logic 31*a* to the rear loading logic 31*b* to begin the right edge position detection processing that uses the rear loading logic 31*b*. The control unit 31 first causes the stepping motor 15 to skip the head unit 10 at high speed from the sheet 2 detection position detected in step B14 to the right home position PR (see FIG. 4) where there is no sheet 2 (step B17).

The control unit 31 then causes the head unit 10 to be moved from the right home position PR to the left in step units of the stepping motor 15 until the sheet 2 is detected by the right edge sensor 12*b* (steps B18 and B19). Namely, if the sheet 2 is not detected by the right edge sensor 12*b* (step B18: NO route), the control unit 31 causes the head unit 10 to be moved by the stepping motor 15 to the left only by one step amount (step B19), and the processing returns to step B18. If the sheet 2 is detected by the right edge sensor 12*b* (step B18: YES), the control unit 31 stores the detected position of the sheet 2 detected in step B18 in the right edge position storage area 44 of the memory unit 40 as the position of the right edge 2*b* of the sheet 2 (step B20), and the processing is complete.

The processing of the abovementioned steps B13 to A20 is processing conducted when the sheet 2 is loaded from the front. The processing of the abovementioned steps B14 to B16 is processing to detect the position of the left edge 2*a* of the sheet 2, and the processing of the abovementioned steps B17 to B20 is processing to detect the position of the right edge 2*b* of the sheet 2.

Conversely, when the sheet 2 is loaded from the rear of the printer (step B12: NO route), the control unit 31 begins the right edge position detection processing that uses the rear loading logic 31*b*. The control unit 31 first causes the stepping motor 15 to skip the head unit 10 at high speed from the center position PC to the right home position PR where there is no sheet 2 (step B21).

The control unit 31 then causes the head unit 10 to be moved from the right home position PR to the left in step units of stepping motor 15 until the sheet 2 is detected by the right edge sensor 12*b* (steps B22 and B23). Namely, if the sheet 2 is not detected by the right edge sensor 12*b* (step B22: NO route), the control unit 31 causes the head unit 10 to be moved by the stepping motor 15 to the left only by one step amount (step B23), and the processing returns to step B22. If the sheet 2 is detected by the right edge sensor 12*b* (step B22: YES), the control unit 31 stores the detected position of the sheet 2 detected in step B22 in the right edge position storage area 44 of the memory unit 40 as the position of the right edge 2*b* of the sheet 2 (step B24).

The control unit 31 then switches from the rear loading logic 31*b* to the front loading logic 31*a* to begin the left edge position detection processing that uses the front loading logic 31*a*. The control unit 31 first causes the stepping motor 15 to skip the head unit 10 at high speed from the sheet 2 detection position detected in step B22 to the left home position PL where there is no sheet 2 (step B25).

The control unit 31 then causes the head unit 10 to be moved from the left home position PL to the right in step units of the stepping motor 15 until the sheet 2 is detected by the left edge sensor 12*a* (steps B26 and B27). Namely, if the sheet 2 is not detected by the left edge sensor 12*a* (step B26: NO), the control unit 31 causes the head unit 10 to be moved by the stepping motor 15 to the right only by one step amount (step B27), and the processing returns to step B26. If the sheet 2 is detected by the left edge sensor 12*a* (step B26: YES route), the control unit 31 stores the detected position of the sheet 2 detected in step B26 in the left edge position storage area 43 of the memory unit 40 as the position of the left edge 2*a* of the sheet 2 (step B28), and the processing is complete.

The processing of the abovementioned steps B21 to B28 is processing conducted when the sheet 2 is loaded from the rear of the printer 1B. The processing of the abovementioned steps B21 to B24 is processing to detect the position of the right edge 2*b* of the sheet 2, and the processing of the abovementioned steps B25 to B28 is processing to detect the position of the left edge 2*a* of the sheet 2.

(2-3) Effect of Second Embodiment

Figure 12:
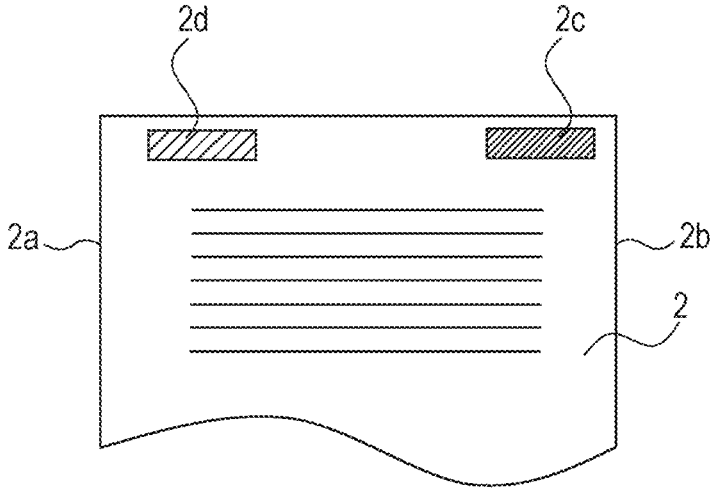
FIG. 12 illustrates an example of a preprinted sheet.
Figure 13:
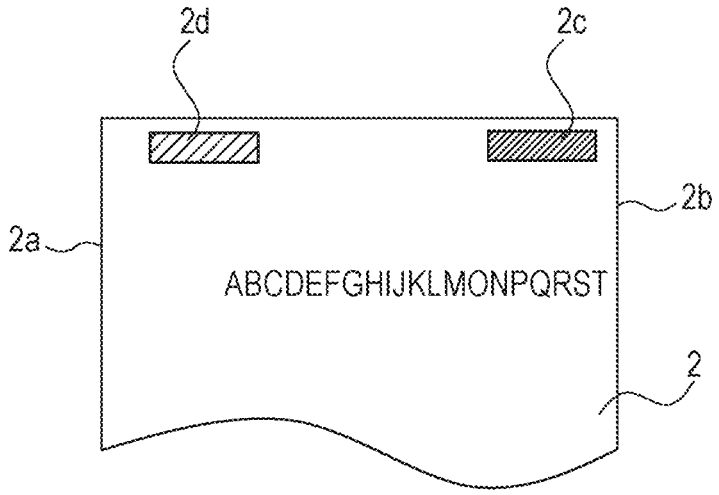
FIG. 13 illustrates an example of a desired printing result on the sheet illustrated in FIG. 12.
Figure 14:
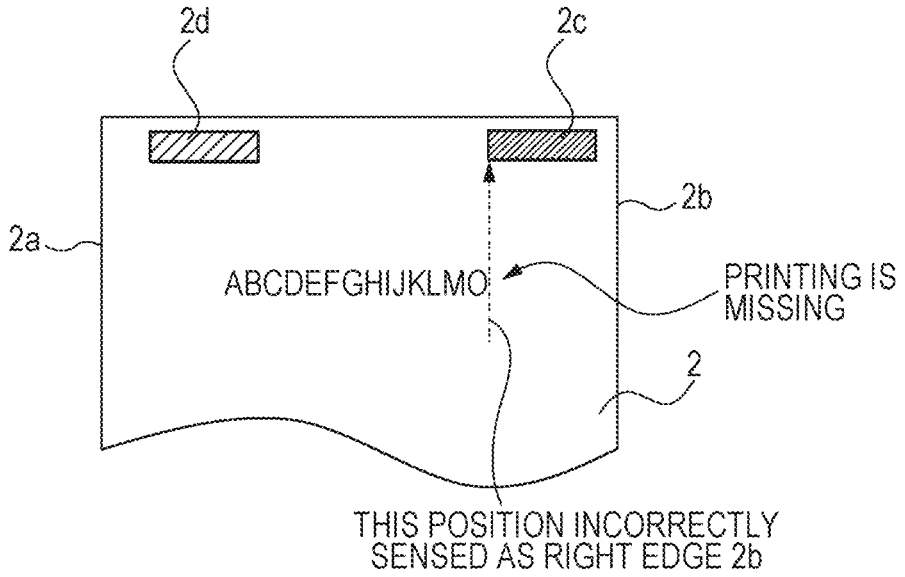
FIG. 14 illustrates an example of a printing result when an edge position in the width direction of the sheet is mistakenly sensed due to the preprint on the sheet illustrated in FIG. 12.

In the conventional procedure when detecting the positions of the left and right edges 2*a* and 2*b* of the preprinted sheet 2 (e.g., see FIG. 12) (front loading), the position of the left edge 2*a* is accurately detected by starting to scan from the left home position where there is no sheet 2. However, the left edge of the preprint portion 2*c* (see FIG. 12) may be mistakenly sensed as the position of the right edge 2*b* since the scanning for the position of the right edge 2*b* starts from the center of the sheet 2.

Conversely, when detecting the position of the left edge 2*a* of the sheet 2 with the printer 1B of the second embodiment, the control unit 31 uses the existing front loading logic 31*a* to conduct the scanning to detect the presence or absence of the sheet 2 by scanning from the left home position where there is no sheet 2 to the right. Conversely, when detecting the position of the right edge 2*b* of the sheet 2, the control unit 31 uses the existing rear loading logic 31*b* to conduct the scanning to detect the presence or absence of the sheet 2 by scanning from the right home position where there is no sheet 2 to the left.

As a result, according to the printer 1B of the second embodiment, the positions of the left and right edges 2*a* and 2*b* of the sheet 2 may be detected without scanning from the center position to the right or to the left, namely, avoiding scanning across the sheet 2, to detect the presence or absence of the sheet 2.

Therefore, even when the sheet 2 includes a preprint, the scanning of the preprint is avoided such that the mistaken recognition of the edges of the preprint as the left or right edges 2*a* and 2*b* of the sheet 2 is reliably reduced, and the edge portions of the sheet to receive the printing are reliably detected.

Thus, printing data may be printed on the sheet 2 as far as the left and right edges 2*a* and 2*b*. Moreover, cancellation of the detection positions of the left and right edges 2*a* and 2*b* of the sheet 2 detected by the sensors 12*a* and 12*b* in order to avoid the mistaken recognition due to the preprint may be avoided thus avoiding the risk of damage to the head pin.

In addition, the detection action by the printer 1B of the second embodiment may be achieved very easily by switching between the existing front loading logic 31*a* and the rear loading logic 31*b* and using the same.

(3) Third Embodiment (3-1) Configuration of Third Embodiment

Figure 7:
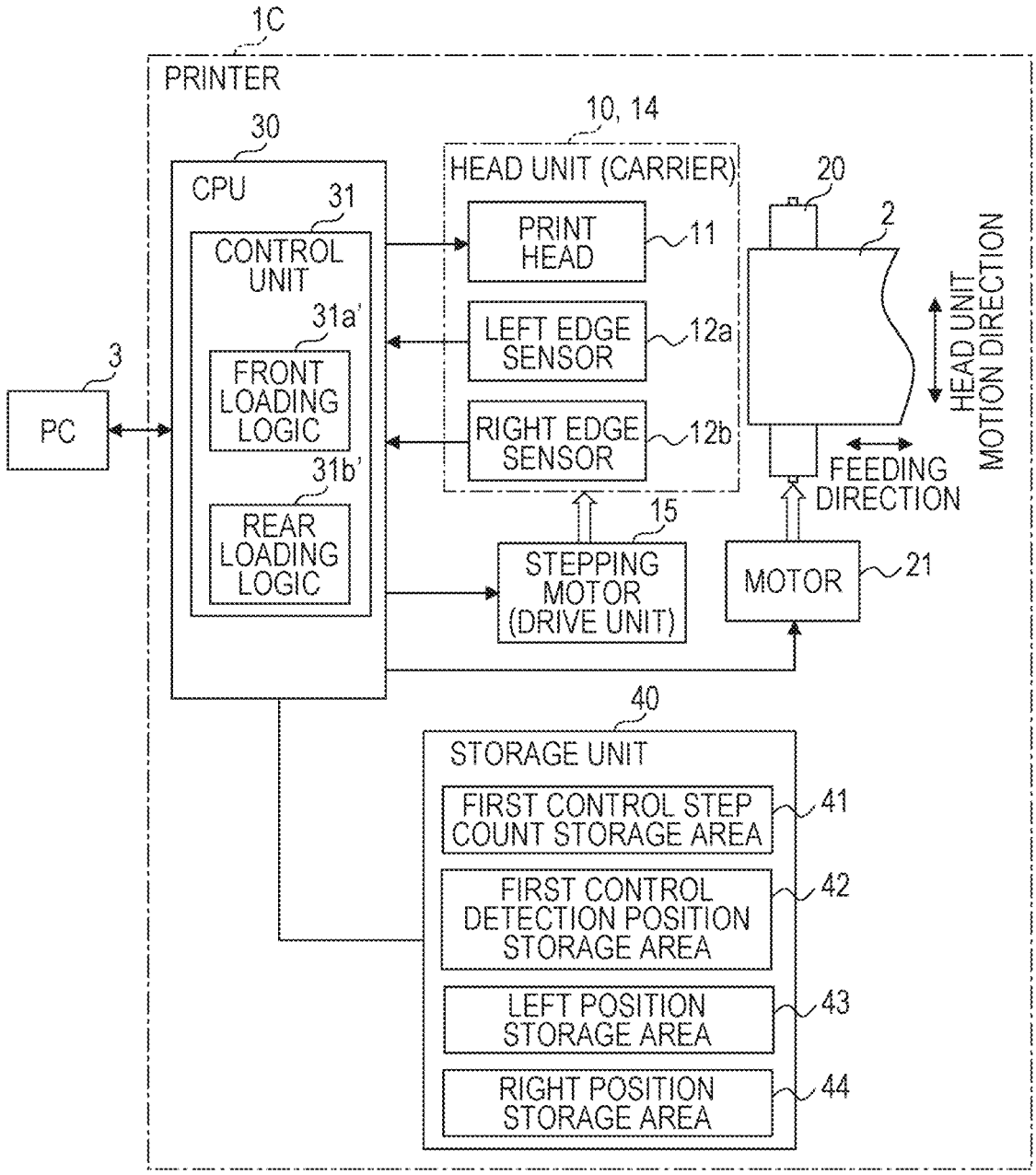
FIG. 7 is a block diagram describing a hardware configuration and a functional configuration of a printing device according to a third embodiment.

FIG. 7 is a block diagram indicating a hardware configuration and a functional configuration of a printing device (printer) 1C according to a third embodiment.

The printer 1C illustrated in FIG. 7 is, for example, a horizontal type serial printer that is configured to allow loading of the sheet 2 from the front or back of the printer in the same way as the printer 1A illustrated in FIG. 1. The printer 1C also has a head unit 10, a stepping motor 15, a platen 20, a motor 21, a central processing unit (CPU) 30, and a memory unit 40 in the same way as the printer 1A. Reference numerals in FIG. 7 that are identical to the abovementioned reference numerals refer to substantially the same portions and thus detailed explanations thereof will be omitted.

The printer 1C of the third embodiment includes the respective functions of the printer 1A of the first embodiment (the first and second controls) in addition to the functions of the printer 1B of the second embodiment (the left edge position detection processing and the right edge position detection processing). As a result, the left edge position detection processing and the right edge position detection processing are faster.

As a result, in the printer 1C of the third embodiment, the memory unit 40 has the first control step count storage area 41, the first control detection position storage area 42, the left edge position storage area 43, and the right edge position storage area 44 in the same way as the first embodiment.

The control unit 31 in the printer 1C of the third embodiment controls the position of the print head 11 with respect to the sheet 2 by controlling the stepping motor 15 based on the detection results from the sensors 12*a* and 12*b*, in the same way as the first embodiment. The control unit 31 of the third embodiment conducts actions to detect the positions of the left and right edges 2*a* and 2*b* of the sheet 2 as described below. The CPU 30 is realized by executing a specific program to perform functions as the control unit 31 to conduct the below-mentioned detection actions.

The control unit 31 conducts left edge position detection processing (FIGS. 8 and 9 steps C14 to C22 and C41 to C49) and right edge position detection processing (FIGS. 8 and 9 steps C23 to C31 and C32 to C40) in a state in which the sheet 2 is at least loaded as far as the positions of the sensors 12*a* and 12*b*.

In the left edge position detection processing, the control unit 31 conducts the first control (FIGS. 8 and 9 steps C14 to C17 and C41 to C44) and the second control (FIGS. 8 and 9 steps C18 to C22 and C45 to C49) in the same way as in the first embodiment.

In the first control of the right edge position detection processing, the control unit 31 causes the stepping motor 15 to move the head unit 10 to the right from the left home position PL. The control unit 31 then obtains detection results by the left edge sensor 12*a* whenever the head unit 10 moves only the first interval that is, for example, an interval that corresponds to ten step amounts of the stepping motor 15. When a change from the absence to the presence of the sheet 2 is detected by the left edge sensor 12*a*, the control unit 31 switches to the second control after saving the changed detected position from the first control in the first control detection position storage area 42 of the memory unit 40.

In the second control of the left edge position detection processing, the control unit 31 causes the stepping motor 15 to move the head unit 10 to the right from a position in the left direction only by the first interval more than the change detection position from the first control. The control unit 31 then obtains detection results by the left edge sensor 12*a* whenever the head unit 10 moves only an interval (the second interval) that corresponds to one step amount of the stepping motor 15. When a change from the absence to the presence of the sheet 2 is detected by the sensor 12*a* and/or the sensor 12*b* accompanying the second control, the control unit 31 recognizes the changed detection position from the second control as the position of the left edge 2*a* of the sheet 2 and saves the left edge position 2*a* in the left edge position storage area 43.

Moreover, in the right edge position detection processing, the control unit 31 conducts the first control (FIGS. 8 and 9 steps C23 to C26 and C32 to C35) and the second control (FIGS. 8 and 9 steps C27 to C31 and C36 to C40) in the same way as in the first embodiment.

In the first control of the right edge position detection processing, the control unit 31 causes the stepping motor 15 to move the head unit 10 to the left from the right home position PR. The control unit 31 then obtains detection results by the right edge sensor 12*b* whenever the head unit 10 moves only the first interval that is, for example, an interval that corresponds to ten step amounts of the stepping motor 15. When a change from the absence to the presence of the sheet 2 is detected by the right edge sensor 12*b*, the control unit 31 switches to the second control after saving the changed detection position from the first control in the first control detection position storage area 42 of the memory unit 40.

In the second control of the right edge position detection processing, the control unit 31 causes the stepping motor 15 to move the head unit 10 to the left from a position in the right direction only by the first interval more than the changed detection position from the first control. The control unit 31 then obtains detection results by the right edge sensor 12*b* whenever the head unit 10 moves only an interval (second interval) that corresponds to one step amount of the stepping motor 15. When a change from the absence to the presence of the sheet 2 is detected by the sensor 12*a* and/or the sensor 12*b* accompanying the second control, the control unit 31 recognizes the changed detection position from the second control as the position of the right edge 2*b* of the sheet 2 and saves the right edge position 2*b* in the right edge position storage area 44.

The CPU 30 then recognizes the positions saved in the areas 43 and 44 of the memory unit 40 as the left edge 2*a* and the right edge 2*b* of the sheet 2 and performs printing control with respect to the sheet 2 such that printing is conducted within the range between the positions.

In the third embodiment, the control unit 31 is constructed to be able to selectively switch between a front loading logic 31*a*' and a rear loading logic 31*b*' and execute the same. The control unit 31 then uses the front loading logic 31*a*' to recognize the position of the left edge 2*a* of the sheet 2 by conducting the abovementioned left edge position detection processing, and also uses the rear loading logic 31*b*' to recognize the position of the right edge 2*b* of the sheet 2 by conducting the abovementioned right edge position detection processing. Herein, the front loading logic 31*a*' and the rear loading logic 31*b*' are ones that respectively include the abovementioned first control and second control in addition to the front loading logic 31*a* and the rear loading logic 31*b* of the second embodiment.

(3-2) Operations of Third Embodiment

Figure 8:
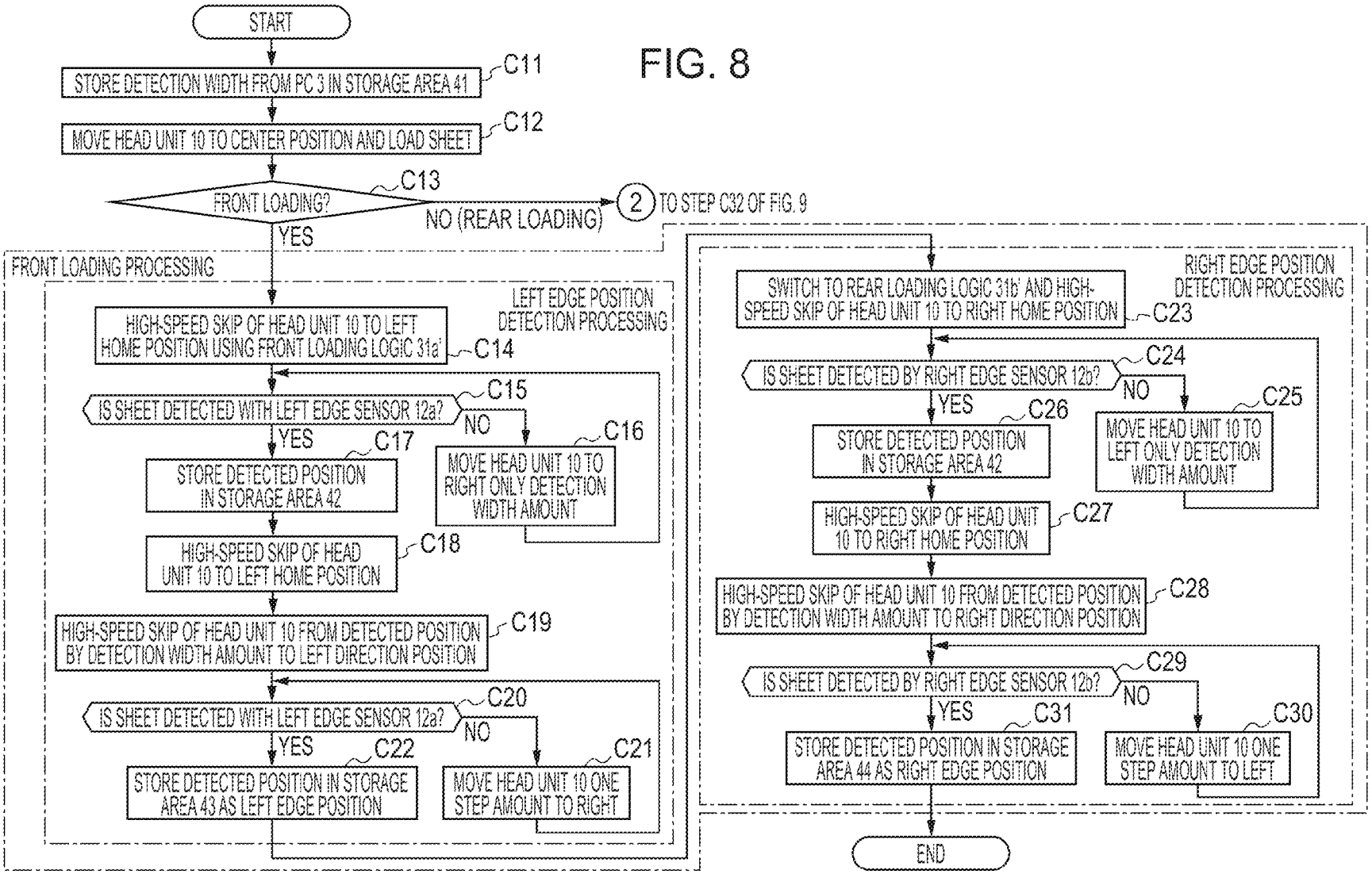
FIG. 8 is a method describing an action of the printing device illustrated in FIG. 7.
Figure 9:
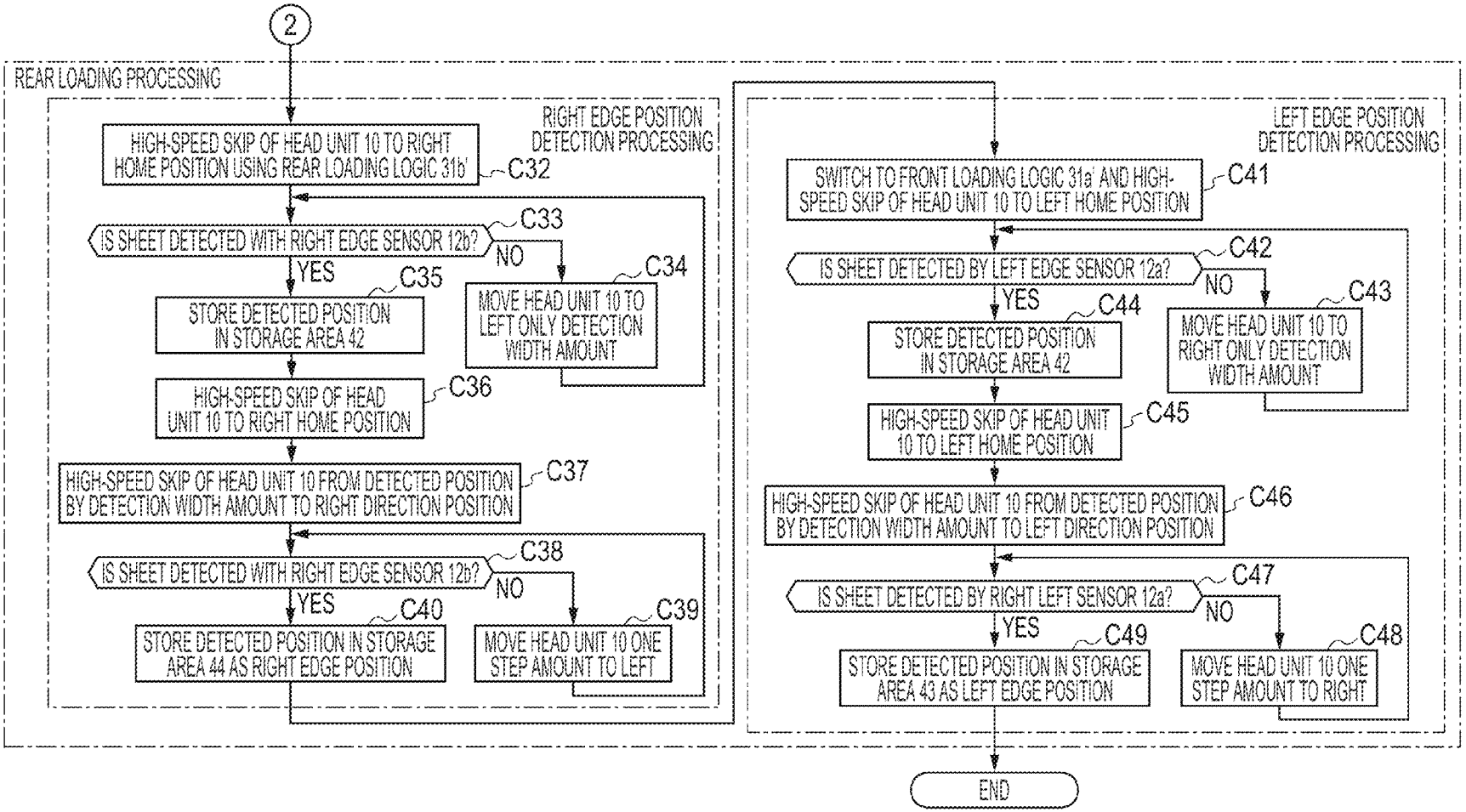
FIG. 9 is a method describing an action of the printing device illustrated in FIG. 7.

A procedure to detect the positions of the left and right edges 2*a* and 2*b* of the sheet 2 by the printer 1C that is configured as described above will be explained hereinbelow according to the methods (steps C11 to C49) illustrated in FIGS. 8 and 9.

When the printer 1C is activated by an instruction from the PC 3, the number of steps (e.g., "10") in the first control that represents the detection width indicated by the PC 3 is first stored in the storage area 41 of the memory unit 40 (step C11). The control unit 31 then causes the head unit 10 to be moved to the center position PC (see FIG. 4) that is a center reference position, and drives the platen 20 using the motor 21 to cause the sheet 2 to be loaded to the position in which the sheet 2 is sensed by both of the sensors 12*a* and 12*b*, that is, as far as the positions of the sensors 12*a* and 12*b* (step C12).

When the sheet 2 is loaded up to the positions of the sensors 12*a* and 12*b*, the control unit 31 judges whether the loading direction of the sheet 2 is from the front of the printer or from the rear of the printer (step C13). The judgment is conducted on the basis of instruction information from the PC 3, or on the basis of the order of sensing of the sheet 2 by the sensors 12*a* and 12*b* as described above.

When the sheet 2 is loaded from the front of the printer (step C13: Yes route), the control unit 31 begins the left edge position detection processing that uses the front loading logic 31*a*'. The control unit 31 first causes the stepping motor 15 to skip the head unit 10 at high speed from the center position PC to the left home position PL (see FIG. 4) where there is no sheet 2 (step C14). Then, the control unit 31 conducts processing similar to the steps A15 to A22 illustrated in FIG. 2 in steps C15 to C22 in FIG. 8. Thus, the detected position of the sheet 2 detected in step C20 (e.g., see position P23 in FIG. 4) is stored in the left edge position storage area 43 of the memory unit 40 as the left edge 2*a* of the sheet 2.

The control unit 31 then switches from the front loading logic 31*a*' to the rear loading logic 31*b*' to begin the right edge position detection processing that uses the rear loading logic 31*b*'. The control unit 31 first causes the stepping motor 15 to skip the head unit 10 at high speed from the sheet 2 detection position detected in step C20 to the right home position PR (see FIG. 4) where there is no sheet 2 (step C23). Then, the control unit 31 conducts processing similar to the steps A34 to A41 illustrated in FIG. 3 in steps C24 to C31 in FIG. 8. Thus, the detected position of the sheet 2 detected in step C29 is stored in the right edge position storage area 44 of the memory unit 40 as the right edge 2*b* of the sheet 2, and then the processing by the control unit 31 is completed.

Conversely, when the sheet 2 is loaded from the rear of the printer (step C13: NO route), the control unit 31 begins the right edge position detection processing that uses the rear loading logic 31*b*'. The control unit 31 first causes the stepping motor 15 to skip the head unit 10 at high speed from the center position PC to the right home position PR where there is no sheet 2 (step C32). Then, the control unit 31 conducts processing similar to the steps A34 to A41 illustrated in FIG. 3 in steps C33 to C40 in FIG. 9. Thus, the detected position of the sheet 2 detected in step C38 is stored in the right edge position storage area 44 of the memory unit 40 as the right edge 2*b* of the sheet 2.

The control unit 31 then switches from the rear loading logic 31*b*' to the front loading logic 31*a*' to begin the left edge position detection processing that uses the front loading logic 31*a*'. The control unit 31 first causes the stepping motor 15 to skip the head unit 10 at high speed from the sheet 2 detection position detected in step C38 to the left home position PL where there is no sheet 2 (step C41). Then, the control unit 31 conducts processing similar to the steps A15 to A22 illustrated in FIG. 2 in steps C42 to C49 in FIG. 8. Thus, the detected position of the sheet 2 detected in step C47 is stored in the left edge position storage area 43 of the memory unit 40 as the left edge 2*a* of the sheet 2 and the processing by the control unit 31 is complete.

(3-3) Effect of Third Embodiment

Therefore, according to the printer 1C of the third embodiment, even when the sheet 2 includes a preprint, the scanning of the preprint is avoided such that the mistaken recognition of the edges of the preprint as the left or right edges 2*a* and 2*b* of the sheet 2 is reliably reduced, and the edge portions of the sheet to receive the printing are reliably detected in the same way as the second embodiment. Thus, printing data may be printed on the sheet 2 to the left and right edges 2*a* and 2*b*. Moreover, cancellation of the detection positions of the left and right edges 2*a* and 2*b* of the sheet 2 detected by the sensors 12*a* and 12*b* in order to avoid the mistaken recognition due to the preprint may be avoided thus avoiding the risk of damage to the head pin.

Moreover, according to the printer 1C of the third embodiment, the positions of the left and right edges 2*a* and 2*b* of the sheet 2 that receives the printing may be detected quickly and in a short time by conducting the first control and the second control in the same way as the first embodiment. Additionally, the positions of the left and right edges 2*a* and 2*b* of the sheet 2 may be detected quickly and in a short time even if the sheet 2 is a non-standard form not related to sheet sizes.

(4) Other

While the embodiments have been described above, the present disclosure is not limited to the abovementioned embodiments and various improvements and modifications are possible without departing from the spirit of the disclosure.

In the abovementioned embodiments, the first interval (detection width) has been described as an interval that corresponds to an amount of ten steps of the stepping motor 15, but the embodiments are not limited as such.

In the abovementioned embodiments, the sensors 12*a* and 12*b* that detect the absence or presence of the sheet 2 have been described as reflective type sensors, but the embodiments are not limited as such. For example, a sensor that detects the presence or absence of the sheet 2 based on a stroke amount of the head pin accompanying the printing action of the print head may be used as the sensor 12*a* or 12*b*. With this detection method, the presence or absence of the sheet 2 is detected by using the reduction of the stroke amount of the head pin when the sheet 2 is present as compared to when the sheet 2 is absent. Therefore, since the presence or absence of the sheet 2 may be detected using the print head 11 when the above detection method is used, the addition of the reflective type sensors for detecting the presence or absence of the sheet 2 may be avoided and the configuration of the device may be simplified.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A printing device comprising:

a head unit that includes a print head that prints on a sheet and a sensor that detects a presence or an absence of the sheet;

a drive unit that causes the head unit to move to a width direction that is orthogonal to a feeding direction of the sheet; and a control unit that controls a position of the print head to the sheet by controlling the drive unit based on a detection result of the sensor, wherein the control unit executes, at least in a state which the sheet is loaded to a position of the sensor, a first control that obtains the detection result of the sensor wherein the detection result is preliminary obtained by moving the head unit at a plurality of first intervals of an equal distance in a specific direction from a reference position until a change from the presence of the sheet to the absence of the sheet or a change from the absence of the sheet to the presence of the sheet is detected and a second control that, after the first control obtains the detection result, causes the head unit to be moved in a direction opposite to the specific direction to a location corresponding to the position where the head unit was located at the interval of the plurality of first intervals before the detection result of the first control was obtained and causes the head unit to be moved at a plurality of second intervals of an equal distance which are shorter than the first intervals until the control unit recognizes the detection result corresponding to a change from the presence of the sheet to the absence of the sheet or a change from the absence of the sheet to the presence of the sheet is detected.

2. The printing device according to claim 1, wherein the control unit obtains, in the first control, the detection result of the sensor whenever the head unit moves only the first interval while the head unit is caused to move by the drive unit in the specific direction from a home position in the absence of the sheet as the reference position and obtains, in the second control, when the change from the absence of the sheet to the presence of the sheet is detected by the sensor during the first control, the detection result of the sensor whenever the head unit moves only the second interval while the head unit is caused to move by the drive unit to a specific direction from a position that is apart, only by the first interval, from a detection position of the change during the first control, in a direction opposite to the specific direction, and recognizes the detection position of the change during the second control as one edge position in the width direction of the sheet when the change from the absence of the sheet to the presence of the sheet is detected by the sensor during the second control.

3. The printing device according to claim 2, wherein the control unit, after recognizing the one edge position in the width direction of the sheet, obtains, in the first control, the detection result of the sensor whenever the head unit moves only the first interval while the head unit is caused to move by the drive unit to the specific direction from a reference position where the sheet is present as the reference position and obtains, in the second control, the detection result of the sensor whenever the head unit moves only the second interval while the head unit is caused to move by the drive unit to the specific direction from the position that is apart, only by the first interval, from a detection position of the change during the first control, in the direction opposite to the specific direction, when the change from the presence to the absence of the sheet is detected by the sensor during the first control, and recognizes the detection position of the change from the second control as another edge position in the width direction of the sheet when the change from the presence of the sheet to the absence of the sheet is detected by the sensor during the second control.

4. The printing device according to claim 1, wherein the drive unit is a stepping motor, the first interval is an interval that corresponds to a specific number of steps of the stepping motor, and the second interval is an interval that corresponds to one step of the stepping motor.

5. A printing device comprising:

a head unit that includes a print head that prints on a sheet and a sensor that detects the presence of the sheet or absence of the sheet;

a drive unit that causes the head unit to move to a width direction that is orthogonal to a feeding direction of the sheet; and a control unit that controls a position of the print head to the sheet by controlling the drive unit based on a detection result of the sensor, wherein the control unit recognizes, as one edge position in the width direction of the sheet, a position where a change from an absence of the sheet to a presence of the sheet is detected by the sensor while the head unit is caused to move by the drive unit to a specific direction from a reference position on one edge side where there is no sheet, in a state where the sheet is loaded at least to a position of the sensor, and the control unit recognizes, as another edge position in the width direction of the sheet, a position where a change from the absence of the sheet to the presence of the sheet is detected by the sensor while the head unit is caused to moved by the drive unit to a direction opposite to the specific direction from another edge side reference position where there is no sheet, at least in a state where the sheet is loaded to the position of the sensor, wherein the control unit, upon recognizing the one edge position in the width direction of the sheet, executes a first control that obtains the detection result of the sensor whenever the head unit moves only a first interval while the head unit is caused to move by the drive unit to a specific direction from the one edge reference position and a second control that, when a change from the absence of the sheet to the presence of the sheet is detected by the sensor during the first control, obtains the detection result of the sensor whenever the head unit moves only a second interval that is shorter than the first interval while the head unit is caused to move by the drive unit to a specific direction from a position that is apart, only by the first interval, from a detection position of the change during the first control, in a direction opposite to the specific direction, and recognizes the detection position of the change from the second control as the one edge position when the change from the absence to the presence of the sheet is detected by the sensor during the second control.

6. The printing device according to claim 5, further configured to allow loading of the sheet from a front of the device or a back of the device, wherein the control unit is configured to allow selectively switching between any of a front loading logic and a back loading logic, and recognizes the one edge position in the width direction of the sheet using the front loading logic and the another edge position in the width direction of the sheet using the back loading logic, the front loading logic recognizing , when the sheet is loaded from the front of the printing device, as the one edge position in the width direction of the sheet, a position where a change from the absence of the sheet to the presence of the sheet is detected by the sensor while the head unit is moved by the drive unit to a specific direction from the reference position on one edge side, and recognizing, as the another edge position in the width direction of the sheet, a position where a change from the presence to the absence of the sheet is detected by the sensor while the head unit is being moved by the drive unit in a specific direction from a reference position where the sheet is present, at least in a state where the sheet is loaded to the position of the sensor, and a rear loading logic recognizing , when the sheet is loaded from the rear of printer, as the another edge position in the width direction of the sheet, a position where the change from the absence to the presence of the sheet is detected by the sensor while the head unit is moved by the drive unit to the opposite direction from the other edge side reference position, and recognizes, as the one edge position in the width direction of the sheet, the position where the change from the presence of the sheet to the absence of the sheet is detected by the sensor while the head unit is moved by the drive unit to the opposite direction from the reference position where the sheet is present, at least in a state where the sheet is loaded to the position of the sensor.

7. The printing device according to claim 5, wherein the control unit, upon recognizing the another edge position in the width direction of the sheet, executes a first control that obtains the detection result by the sensor whenever the head unit moves only the first interval while the head unit is caused to move by the drive unit to the opposite direction from the another edge reference position and a second control that, when the change from the absence to the presence of the sheet is detected by the sensor during the first control, obtains the detection result of the sensor whenever the head unit moves only the second interval that is shorter than the first interval while the head unit is caused to move by the drive unit to the specific direction from a position that is apart, only by the first interval, from a detection position of the change during the first control, in a direction opposite to the specific direction, and recognizes the detection position of the change in the second control as the another edge position when the change from the absence to the presence of the sheet is detected by the sensor during the second control.

8. The printing device according to claim 5, wherein the drive unit is a stepping motor, the first interval is an interval that corresponds to a specific number of steps of the stepping motor, and the second interval is an interval that corresponds to one step of the stepping motor.

9. The printing device according to claim 5, wherein the sensor detects the presence or absence of the sheet according to a head pin stroke amount during a printing action of the print head.

10. A method for detecting a sheet width direction edge position by a printing device having a head unit that includes a print head that prints on a sheet and a sensor that detects a presence or an absence of the sheet, the method comprising:

recognizing, as one edge position in the width direction of the sheet, a position where a change from the absence to the presence of the sheet is detected by the sensor while the head unit is moved by the drive unit to a specific direction from a reference position on one edge side where there is no sheet, at least in a state where the sheet is loaded to a position of the sensor, and recognizing, as another edge position in the width direction of the sheet, a position where a change from the absence of the sheet to the presence of the sheet is detected by the sensor while the head unit is moved by the drive unit to a direction opposite to the specific direction from the another edge side where there is no sheet, at least in a state where the sheet is loaded to the position of the sensor, further comprising:

upon recognizing the one edge position in the width direction of the sheet, executing a first control that obtains the detection result of the sensor whenever the head unit moves only a first interval while the head unit is caused to move by the drive unit to the specific direction from the one edge reference position;

executing a second control that, when a change from the absence to the presence of the sheet is detected by the sensor during the first control, obtains the detection result of the sensor whenever the head unit moves only a second interval that is shorter than the first interval while the head unit is caused to move by the drive unit to the specific direction from a position that is apart, only by the first interval, from a detection position of the change during the first control, in a direction opposite to the specific direction, and recognizing the detection position of the change in the second control as the one edge position when the change from the absence to the presence of the sheet is detected by the sensor during the second control.

11. The method according to claim 10, further comprising:

upon recognizing the another edge position in the width direction of the sheet, executing a first control that obtains the detection result by the sensor whenever the head unit moves only a first interval while the head unit is caused to move by the drive unit to the opposite direction from the another edge reference position;

executing a second control that, when a change from the absence to the presence of the sheet is detected by the sensor during the first control, obtains the detection result of the sensor whenever the head unit moves only a second interval that is shorter than the first interval while the head unit is caused to move by the drive unit to the specific direction from a position that is apart, only by the first interval, from a detection position of the change during the first control, in a direction opposite to the specific direction, and recognizing the detection position of the change from the second control as the another edge position when the change from the absence to the presence of the sheet is detected by the sensor during the second control.

12. The method according to claim 10, wherein the drive unit is a stepping motor, the first interval is an interval that corresponds to a specific number of steps of the stepping motor, and the second interval is an interval that corresponds to one step of the stepping motor.

* * * * *